US006516583B1

(12) United States Patent
Houghton

(10) Patent No.: US 6,516,583 B1
(45) Date of Patent: Feb. 11, 2003

(54) GUSSET PLATE CONNECTIONS FOR STRUCTURAL BRACED SYSTEMS

(76) Inventor: David L. Houghton, Houghton, Myers and Nelson, LLC, Baytower Corporate Centre, 15901 Hawthorne Blvd., Ste. 400, Lawndale, CA (US) 90260

( * ) Notice: Subject to any disclaimer, the term of this patent is extended or adjusted under 35 U.S.C. 154(b) by 0 days.

(21) Appl. No.: 09/280,136

(22) Filed: Mar. 26, 1999

(51) Int. Cl.[7] ..... E04C 3/32; E04B 1/98

(52) U.S. Cl. ..... 52/655.1; 52/167.3; 52/638; 52/729.1; 52/653.1

(58) Field of Search ..... 52/167.3, 167.4, 52/236.3, 263.6, 633, 638, 641, 643, 646, 647, 655.1, 653.1, 650.1, 650.2, 729.1, 693; 403/403, 237, 232.1, 314

(56) References Cited

U.S. PATENT DOCUMENTS

| | | | | |
|---|---|---|---|---|
| 574,434 | A | * 1/1897 | Keithley | |
| 1,883,376 | A | * 10/1932 | Hilpert et al. | |
| 2,458,606 | A | * 1/1949 | Knabe | 52/729.1 |
| 3,716,959 | A | * 2/1973 | Bernardi | 52/729.1 X |
| 3,952,472 | A | * 4/1976 | Boehmig | |
| 4,409,765 | A | * 10/1983 | Pall | 52/167.3 |
| 4,476,662 | A | * 10/1984 | Fisher | |
| 4,648,216 | A | * 3/1987 | Reaves et al. | |
| 4,974,387 | A | * 12/1990 | Dufour | 52/643 X |
| 5,148,642 | A | * 9/1992 | Plumier et al. | 52/167.3 |
| 5,263,296 | A | * 11/1993 | Spera | 52/638 |
| 5,503,493 | A | * 4/1996 | Kato et al. | 403/312 |
| 5,577,353 | A | * 11/1996 | Simpson | |
| 5,628,156 | A | * 5/1997 | Taris | |
| 5,660,017 | A | * 8/1997 | Houghton | |
| 5,680,738 | A | * 10/1997 | Allen et al. | 52/729.1 |
| 5,802,782 | A | * 9/1998 | Jewell | |
| 5,806,265 | A | * 9/1998 | Sluiter | 52/643 |
| 6,073,405 | A | * 6/2000 | Kasai et al. | 52/655.1 X |
| 6,138,427 | A | * 10/2000 | Houghton | |

FOREIGN PATENT DOCUMENTS

| | | | |
|---|---|---|---|
| CA | 771849 | * | 7/1978 |
| RU | 619608 | * | 7/1978 |

* cited by examiner

*Primary Examiner*—Lanna Mai
*Assistant Examiner*—Winnie Yip
(74) *Attorney, Agent, or Firm*—L. Lee Humphries

(57) ABSTRACT

This invention is a structural joint having a diagonal brace, beam and column fixedly attached with respect to each other by parallel gusset plates disposed in face-to-face relationship on opposite sides of the brace, beam and column and extending from the column along the sides of the beam and the brace. The other end of the diagonal brace may be attached to another structural joint of beam and column, or to another beam only, or to another column only, by fixedly attaching with respect each other, as the case may be, the parallel gusset plates disposed in face-to-face relationship on opposite sides of the brace, beam and column.

38 Claims, 11 Drawing Sheets

GUSSET PLATE CONNECTIONS FOR STRUCTURAL BRACED SYSTEMS

This application is related to U.S. Pat. No. 5,660,017, entitled Moment Resisting Frame Beam-To-Column Connections, issued Aug. 26, 1997, invented by the same inventor as herein. There is a relation also to patent application U.S. Pat. No. 6,138,427, issued Oct. 31, 2000, entitled Moment Resisting, Beam-To-Column Connection, invented by the same inventor as herein.

This invention relates to structural connections between braces, beams and columns, using parallel gusset plate technology. As taught herein, gusset plates may be used to connect a brace, column and beam or, also, to connect a brace to a beam or a column. The use of gusset plates to connect beams to columns was taught in patent U.S. Pat. No. 5,660,017, mentioned above. This invention improves upon the structural connections taught in that patent, by reconfiguring the parallel gusset plates to receive diagonal braces. Thus, wherein the brace, column and beam are connected by parallel gusset plate, the system is a "dual" system because it uses gusset plates to attach both beams and braces to columns, thereby combining, interactively, a structurally braced lateral load resisting connection system with a structural moment resisting frame connection system. Similarly, wherein the brace and column only are connected by parallel gusset plates, the system is a special braced system because it acts alone to resist lateral loads.

The most commonly used braces, in this invention, are those known as wide-flanged "H" braces. Such braces have two wide flanges connected to each other by a web. The beams and columns most commonly used are "H" beams and columns, having two flanges and a web interconnecting them. However, other shapes may be used for brace, beam or column, or any combination thereof. Tube shapes and built-up box shapes are commonly known and used. It is to be appreciated that a box shape may be considered to have two flanges and two webs, acting in any principal direction, with the flanges in one principal direction acting as webs in the other principal direction, when loaded biaxially. Similarly, a built-up cruciform column may be used. Such cruciform column has four flanges and two webs which cross each other, described and discussed hereinafter, which flanges combine to provide significant stiffness and strength in each principal direction.

This invention is most useful in construction of single and multiple story buildings having a framework of structural steel. It is useful in either new construction or in retrofit construction of steel frame buildings to create a structure with both increased ductility and lateral stiffness.

It is to be appreciated that such joint connections would be useful in bridges and other structures using steel beams.

BACKGROUND OF THE INVENTION

It has been found that substantial improvement is needed in the moment-resisting capabilities of beam-to-column connections in prior, structural steel buildings. Continuing and similar experience has been recently gained from both laboratory testing and from earthquakes, high winds, hurricanes, tornadoes, blasts, explosions and various other severe loading conditions which have happened, and which will continue to happen when using prior brace-to-column and prior brace-to-beam structural connections. Such loading conditions place similar demands on braced structural connection systems as they do on moment-resisting frame structural connection systems, which severe loading conditions in the past, have resulted in brittle fracture of both connection weld metal and base metal.

It is now common knowledge that prior beam-to-column connections and brace-to-column and brace-to-beam connections, which often used complete penetration welded joints between beam flange and column flange, and between the brace flange and the column flange and between the brace flange and the beam flange are not adequate and are susceptible to brittle fracture of the connection elements and the base metal, under severe loading conditions. The old, traditional, connection technology simply does not provide the needed strength and ductility required to withstand extreme loading conditions.

The prior art teaches numerous ways to connect beams and braces to columns. Previously, the common brace-to-beam and brace-to-column connection has been through the use of a single gusset plate welded or bolted to brace, beam and column. Other common brace-to-beam and brace-to-column connections used previously, involve welding at a skewed angle, the brace flanges directly to the faces of the column and beam flanges, respectively, using large, highly-restrained, full-penetration, single-bevel groove welds. This connection may actually be more vulnerable to brittle fracture than its common previously used moment-resisting frame beam-to-column connection counterpart, in part due to a more restricted access for welding.

In the prior beam-to-column connection, the beam has often had the ends of its top and bottom flanges welded to one flange, or face, of the column by large, highly-restrained, full-penetration, single bevel groove welds.

There has been partial or complete failure of the highly-restrained welds between the beam flange and the column flange, either by a crack in the weld itself or a crack along the heat affected zone of the column flange, and/or a crack in the column flange base metal, pulling a divot of column steel from the face of the column flange.

In addition, failures between the beam flange and column flange have resulted in shear failure of the high strength bolts connecting the shear tabs to the web of the beam for the support of the gravity loads. Vertical loads, that is, the weight of the floors and gravity loads acting on the floors, are commonly carried by vertical shear tabs. Each such shear tab is vertically disposed and is welded to the face of the column and bolted or welded to the web of the beam, at the end of the beam which is nearest the column, using high-strength bolts.

Subsequent attempts by the building industry to improve beam-to-column connections and brace-to-column and brace-to-beam connections still rely on post-yield straining of large, highly-restrained, full-penetration, single-bevel grooves welded under field conditions. Such highly-restrained welds do not provide a reliable mechanism for dissipation of earthquake energy, explosion or blast energy, or other large forces, and can lead to brittle fracture of the weld and the column. Such brittle fracture shows that the design violates the ductile design intent of the Uniform Building Code, for both moment-resisting frame connection systems and special braced frame connection systems.

Of course, there are other requirements to be met, some of which are set forth in AISC (American Institute of Steel Construction) publications, including, but not limited to, the LRFD (Load and Resistance Factor Design) specifications and ASTM (American Society for Testing and Materials) publications, as well as ASME (American Society of Mechanical Engineers).

Skilled in the art structural engineers, designing strengthened structural steel buildings are familiar with the various design requirements set forth in those publications and the various State and local building codes which may be involved.

Contrary to prior beam-to-column structural joint connections, and brace-to-column and brace-to-beam structural joint connections, the present invention, by taking advantage of parallel gusset plate technology, does not rely heavily on post-yield straining of the joint connection.

In the case of earthquakes and explosions, greater strength and ductility are particularly desirable in resisting sizeable loads in both the lateral and the vertical directions.

Parallel gusset plate technology, or, simply, gusset plate technology, as taught in the patent mentioned above, has been a substantial step forward in strengthening the beam-to-column connections in a building comprised of structural steel beams and columns. Two parallel gusset plates are attached on opposite sides of a column and attached on opposite sides of a beam, to connect the beam to the column.

Engineering analysis, design and testing have determined that the advancement provided by the parallel gusset plate technology can be further advanced and improved by using gusset plate technology to add braces in the form of a dual structural system, or to connect a brace to either a column or a beam without a moment connected beam-to-column connection at the same location, to better resist and withstand the sizeable loads which are placed on a building structure in a disaster.

Braces have long been used to add both vertical and lateral stiffness and to strengthen steel construction, in buildings and truss style bridges. But prior art has not used parallel gusset plate technology, for connecting and combining both braces and beams to columns. Nor has the prior art used welds to connect a brace, (which extends between parallel gusset plates welded to a column), to the parallel gusset plates either directly or through the use of cover plates. Structural engineers are aware that mere addition of braces could cause too much stiffness in the structure, when, as a matter of fact, substantial ductility and yielding is required in order to absorb the tremendous energy involved in heavy, disastrous overloading from, for example, an earthquake, a hurricane or an explosion. Without the ductility and yielding, the brace would be susceptible to buckling and failing in compression.

Applicant has previously developed parallel gusset plate technology to strengthen beam-to-column connections and has obtained the above-mentioned patent U.S. Pat. No. 5,660,017, entitled Steel Moment Resisting Frame Beam-To-Column Connections and, further, has filed patent application Ser. No. 09/141,714, entitled Moment Resisting, Beam-To-Column Connection. Those patent documents disclose a great deal about strengthening beam-to-column connections through the use of parallel gusset plates. The teachings therein are incorporated herein by reference.

As pointed out previously herein and in the mentioned patent documents, such gusset plate technology also works well with tube shapes and with box shapes. For example, the box shapes may be a box brace, a box beam or a box column.

Columns are commonly strengthened by horizontal shear plates welded between flanges, on each side of the web of the column. Beams are strengthened by vertical shear plates, which also carry vertical loads in shear, which shear plates are fillet welded to beam flanges and the beam web as well as to the gusset plates. Column composite dynamic shear capability may also be increased, for "H" columns, by providing concrete in fill in the space between column flanges, on each side of the column's web, wrapped using fiberglass jackets or, even using external jackets of structural steel, to provide ductile containment of the infill. For tube columns or box columns, containment of concrete infill is self-provided by the column's own shape.

In general, in gusset plate technology, two parallel gusset plates connect a beam to a column, using fillet welds to fixedly attach the gusset plates with respect to the beam and using fillet welds to fixedly attach the gusset plates to a column. Where necessary, top and bottom cover plates are used to bridge the difference between the beam flange width and the width between the gusset plates, which is the width of the column flanges. Fillet welds are used between the cover plates and the flanges of the beam, and between the gusset plates and the column flanges. Alternatively, in the case of a beam whose flange width is as wide as the column flange, the flanges of the beam are welded directly to the gusset plates. Such gusset plate technology is eminently successful.

SUMMARY OF THE INVENTION

As mentioned hereinabove, disastrous events, such as earthquakes, high winds, hurricanes, tornadoes, blasts, explosions and the like cause severe loading on steel structural constructions. When braces are used in the structure, some of the severe loads are severe moment loads on the braces. This invention teaches a person skilled in the art, a structural joint comprised of column and beam connected by a pair of gusset plates. In addition, this invention teaches a column, beam and brace connected by the same gusset plates. Each of the gusset plates is fixedly attached with respect to the brace by a severe moment-resisting connection, that is, a connection strong enough to resist severe moment loads beyond normal gravity loading, such as those loads caused by the above-mentioned disastrous events. Thus, in the joint connection, the same gusset plates which provide fixed attachment of the beam with respect to the column are used to provide the fixed attachment of the brace with respect to the joint connection of the beam and the column.

The invention herein enhances the prior-used and prior-disclosed parallel gusset plate, beam-to-column technology by fixedly attaching braces directly to the parallel gusset plates or to intermediate bridge plates which, in turn, are connected to the gusset plates.

The braces may be attached by bolts, rivets or by welding. If welded, the preferred weld is the fillet weld, which, in this invention, is usually directed in the same direction as the line of greatest strain. The brace, in the preferred embodiment is bolted or, possibly, riveted, to the gusset plates, using oversize holes, thus providing a yielding, energy-dissipating connection between the brace and the beam and between the brace and the column.

If the brace is fillet welded to the parallel gusset plates, the fillet weld carries the load along its longitudinal length in shear, rather than across its narrow width in tension, which transfer in shear is inherently robust and ductile in performance.

The addition of braces to parallel gusset plate technology, as taught in the preferred form of this invention, creates a structural dual system when combined with a beam-to-column connection at the same location. Thus, the structural system of the invention provides even greater strength, frame continuity, and structural redundancy and stability in both horizontal and vertical directions, without compromising connection system ductility.

The structural redundancy and frame continuity of this invention, using parallel gusset plate technology in a dual system application are provided by the creation of monolithic steel frames which combine and integrate complementing structural lateral load resisting systems using parallel gusset plates that are fixedly attached with respect to the concentric intersection of braces, beams and columns, using fillet welded construction to join the connection elements.

The joint connections taught herein comply with the seismic provisions for steel frame buildings, issued by the International Conference of Building Officials and the American Institute of Steel Construction.

One significant feature of the gusset plate technology, which is enhanced further by the brace-to-column parallel gusset plate technology is that it is cost-effective. By providing stiffer beam-to-column connections, combined with a braced structural system which is also made stiffer by the use of gusset plate technology, lighter steel beams, columns and braces can be used, while still providing greater overall ductility and lateral stiffness in the structure of the building, compared to prior structures.

The same stiffness advantage is applicable when only braces are connected to columns using brace-to-column parallel gusset plate technology.

Just as with the beam-to-column gusset plate technology, the brace-to-column and brace-to-beam gusset plate connection systems taught herein may be fabricated in the shop under controlled conditions for placement in a new structure, or placed in the field during retrofitting of a previously-built structure. Shop fabrication provides for better quality construction by reason of better control of the manufacturing process and easier access to and handling of all parts of the connection. The invention makes use of fillet welds in some embodiments of the brace-to-gusset plate connection. The invention still takes advantage of the beam-to-column parallel gusset plate connection which uses fillet welds and which are better and more easily made under shop conditions. However, the invention can suitably be manufactured in the field.

Splice connections are commonly used in the field to insert stub sections. In the shop, where quality is more easily and better controlled, gusset plates can be attached to a column, a beam stub, and/or a brace stub, each of which stubs are suitably spliced into the link beam and/or link brace structure in the field. Such splice connections are, preferably, located at structural points of reduced flexural stress. That is, the splice connections are commonly located at some distance from the brace-to-column and beam-to-column connection.

Welds are commonly used to structurally connect brace stubs to link braces and to connect beam stubs to the link beams. Such welds are usually complete joint penetration groove welds using a flange-to-flange and web-to-web welded butt joint configuration. If done properly, the welded joint is as strong or is stronger than the non-welded portion of the beam or column. In other embodiments, bolted or riveted plates may be used to connect link beams or braces.

The steel elements used in most buildings having steel frameworks, are likely to be what is known as A-36 specification, structural steel, or A572 Grade 50 specification, structural steel, except for the bolts and washers.

In bolting the braces to the gusset plates, oversize bolt holes facilitate construction and provide energy dissipating mechanisms through bolt slippage at high stress levels. Such slippage has been determined capable of dissipating substantial additional energy in the event of seismic overload, tornadoes or other severe stress being placed on the structure. Bolts which are used in most steel construction and in this invention are most commonly slip-critical A490 or A325 tension-controlled bolts.

In bolting, it is common practice to drill the bolt holes to be slightly oversized. The bolts, for example, that would be used in this invention are, of course, high-strength bolts. The oversize bolt holes allow easier fitting together of the structural elements and, further, provide an energy dissipation mechanism through bolt slippage at high stress levels. Washers are commonly included, in accordance with customary practice, although washers are not shown in the various Figures herein, because they are so relatively small in size. It would be expected that all bolting would include washers. The bolts used throughout the invention are high strength bolts which can be field or shop bolted. The bolts in the oversized holes are tightened to be slip-critical, meaning the adjoined metal plates cannot slip or move under designed load.

The prior beam-to-column gusset plate invention, as taught in patent U.S. Pat. No. 5,660,017, referred to above, utilizes unrestrained, inherently-ductile fabrication by fillet welds which are loaded principally in shear in the directions of great strain, by parallel gusset plates which connect the beams to the columns and by the elimination of prior, highly-restrained, groove welds between beam flange and column flange.

This invention continues with that concept by adding, or, substituting (as applicable), braces to such parallel gusset plate construction, with welds which run in the direction of great strain, that is, along the longitudinal axis of the brace. In the preferred embodiment, the braces lie diagonally in the vertical planes of the building. In other embodiments such braces may be connected and disposed to lie diagonally in horizontal planes within the building. Of course, it is to be recognized that in some embodiments, in tower construction or triangular construction, the planes may not be truly vertical.

Vertical stability, stability in the vertical plane, is achieved by the great strength of the gusset plates and their strong connection to column, beam and brace. The joint connections of the present invention, which adds diagonal braces to the gusset plates, can be designed to withstand a load that is greater than the plastic moment capacity of the connected beam.

Lateral stability, stability in the horizontal plane, is achieved in the instant invention, by the structural frame of the building in such horizontal plane. That is, the beams connecting each column to its adjoining columns and beams provide the primary resistance to moments in the horizontal plane.

It has been pointed out above, that rivets or welds might be used in place of the bolts, in attaching braces to gusset plates. However, bolts are preferred for use in such structural joints. The term "fastener" or "fasteners" herein is intended to include either or both bolts and rivets. Such "fasteners" allow slippage and provide an energy dissipating mechanism. "Fastened" is intended to include attachment by use of "fasteners". "Attached" herein, includes "fastened", (bolted or riveted), and "welded". "Welds" and "welded" includes fillet welds and, also, complete joint penetration, groove welds and other welds, provided they are suitable to meet the design requirements of the building.

One end of a brace may be connected to one beam-to-column set of gusset plates, and the other end of the brace may be connected diagonally to another beam-to-column set of gusset plates.

However, it is to be appreciated that while one end of a diagonal brace may be connected to one beam-to-column set of gusset plates, the other end of the diagonal brace may be connected or fixedly attached otherwise, that is, to the beam a selected distance from the beam-to-column connection. This selected distance provides an "eccentric link", (a section of the beam between its connection to the brace and its connection to the column), which "eccentric link" serves to provide energy absorption through ductile shear and bending deformation, to allow columns, joints and connections to remain stable. That is, the linking beam, to which the brace is attached, bends and provides ductility and reserve for greater energy absorption capability.

Parallel gusset plate technology also permits usage of "concentric" braced frames, (wherein two braces meet at a beam and use a single set of two parallel gusset plates to attach braces and beam), or in "eccentric" braced frames (wherein two braces are attached to a beam by two, separate sets of two parallel gusset plates, a fixed distance apart—a predesigned "eccentric link" distance).

It is, therefore, an object of this invention to provide substantially strengthened joint connections using parallel gusset plate technology to connect brace to beam and column, brace to column and brace to beam.

Another object of this invention is to provide a brace-to-column, brace-to-beam and beam-to-column joint connection using a single set of parallel gusset plates.

A further object of this invention is to provide a brace-to-column and brace-to-beam joint connection which provides an energy dissipating mechanism through bolt slippage at high stress levels, using parallel gusset plates.

Still another object of this invention is to provide structural redundancy by creating a dual, lateral load resisting connection system that connects brace to column and beam to column, using mutually common parallel gusset plates, without reliance on beam flange-to-column flange welded connections.

Still another object of the invention is to provide a structural brace-to-column and beam-to-column structural joint connection which eliminates post-yield straining of large highly-restrained, full-penetration groove welds.

A still further object of this invention is to provide suitable structural brace connections in structural buildings using either "eccentric links" or using concentrically braced framing configurations.

Further objects and features will become apparent from the following drawings and description.

DETAILED DESCRIPTION

Figure 1:
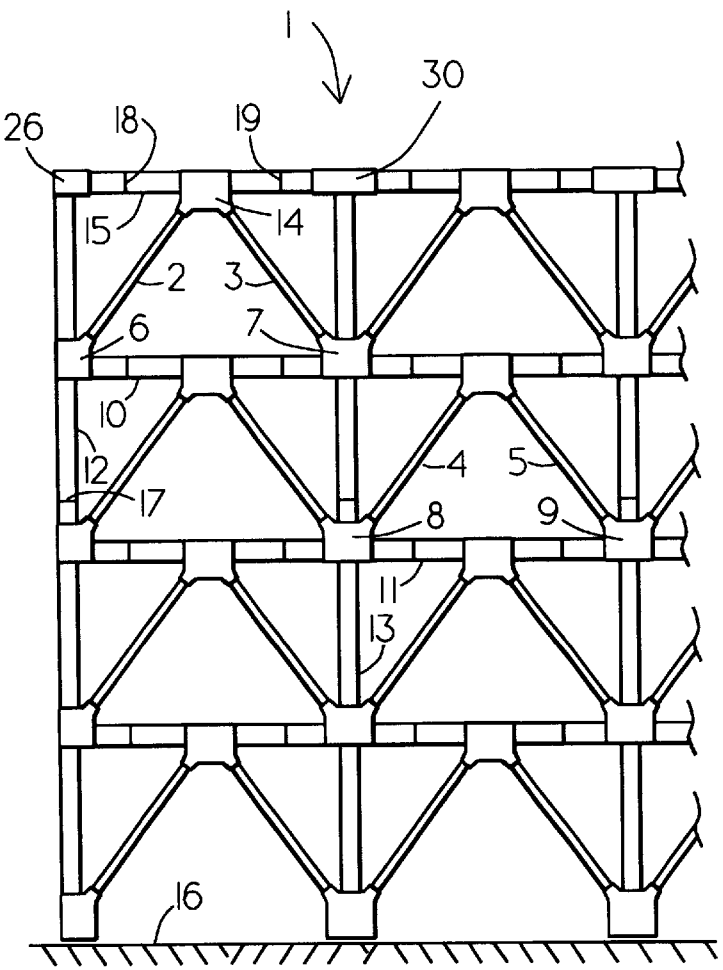
FIG. 1 is a partial, elevation view of the structural steel framework of a building, showing a number of diagonal braces, each concentrically connected, at one end, to parallel gusset plates which are further connected to a column or a beam and a column. The other end of each brace is connected to a set of parallel gusset plates, to which is connected another brace, which parallel gusset plates are connected to an intermediate portion of another beam.

FIG. 1 is a partial, elevation view of the structural steel framework 1 of a building, showing a number of diagonal braces, such as braces 2, 3, 4, and 5, fixedly attached, at one end, to gusset plates, 6, 7, 8 and 9, which are further connected to beams 10 and 11, and columns 12 and 13. It is to be understood, of course, that gusset plate 6, for example, has a corresponding, parallel gusset plate, (hidden behind it), to which beam 2 is also fixedly attached. "Fixedly attached to" includes within its meaning, "directly attached to" or attached through intermediate plates, angle irons or other structure. "Fixedly attached with respect to" includes within its meaning, "fixedly attached to", "directly attached to" and attached through intermediate plates, angle irons or other structure. Preferably, the flange on each side of the brace is bolted directly to its respective gusset plate. The other end of the brace 2, for example, is connected through a pair of parallel gusset plates, (only gusset plate 14, of the pair, being visible), along with brace 3, to an intermediate portion of beam 15. Connecting one end of brace 2 and brace 3 to beam 15, concentrically through a common pair of parallel gusset plates of which only gusset plate 14 is visible, and connecting concentrically the other end of brace 2 to column 12 and beam 10 through another set, or pair, of parallel gusset plates, only parallel gusset plate 6, of the pair, being visible, and further concentrically connecting brace 3 to column 13 and beam 10 through another pair of parallel gusset plates, only gusset plate 7, of the pair, being visible, respectively, creates a "special concentric braced frame" system. Hereafter, FIGS. 2, 4, 5 and 5A show similar "special concentric braced frame" systems.

Splicing of columns is common in the art. Commonly, it is done by welding column sections together. Welded splice line 17 in column 12 is illustrative of such splicing, which can be seen also in the other columns. Beams are also spliced together, by bolting or by welding. Welded splice lines 18 and 19 in beam 15 is illustrative of such splicing in beams.

It is noted that gusset plates 6, 7, 8, 9, 14, and the like gusset plates, have extensions adapted to receive and be fixedly attached to the various braces 2, 3, 4, 5 and the like. Such extensions and attachments will be more specifically discussed and shown hereafter.

Gusset plate 26 and wide gusset plate 30 are those prior gusset plates taught in U.S. Pat. No. 5,660,017, mentioned above. Wide gusset plate 30 is simply an adaptation of the gusset plate so as to receive beams on both sides of a column.

The structural framework 1, that is, the entire building, is shown resting on any sort of suitable understructure, represented by line 16.

FIG. 1 illustrates braces 2 and 3 meeting at the center of beam 15 and being connected to the beam by a pair of gusset plates, of which only gusset plate 14 is visible. In some structures, the structural design might have braces 2 and 3 meet at other locations along beam 15, than at the center of beam 15. This, of course, would be one form of an "eccentric braced frame".

Figure 2:
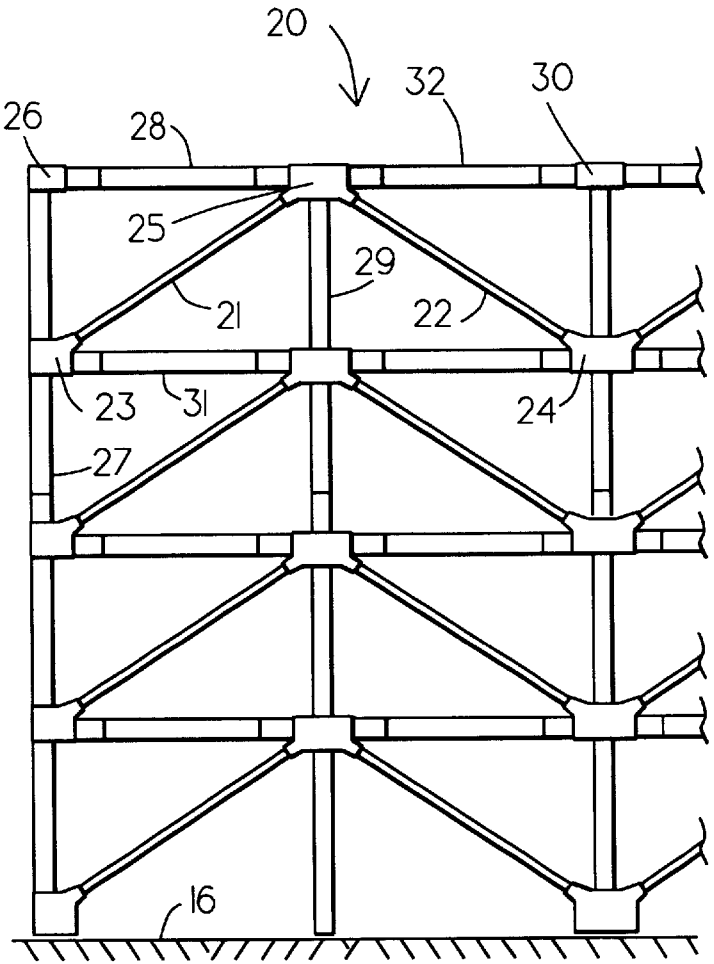
FIG. 2 is a partial, elevation view of the structural steel framework of a building, in which the braces are concentrically connected diagonally from one beam-to-column connection to another beam-to column connection, in inverted "V" configuration. In some cases, the parallel gusset plates connect the braces only to a column.

FIG. 2 is a partial, elevation view of the structural steel framework 20 of a building, in which brace 21 is shown connected diagonally from one pair of parallel gusset plates, (only gusset plate 23, of the pair, being visible), to another set of parallel gusset plates, (only gusset plate 25, of the pair, being visible). Brace 22 is shown connected diagonally from one pair of parallel gusset plates, (only gusset plate 24, of the pair, being visible). Both braces 21 and 22 are concentrically connected to a pair of parallel gusset plates, one of which, gusset plate 25, is visible.

Gusset plate 23, and its corresponding, (hidden) gusset plate, further connect beam 31, as well as brace 21, to column 27. Gusset plate 25, and its corresponding, (hidden), gusset plate, further connect beam 28 and beam 32 to column 29.

Braces 21 and 22, can be seen to be in inverted "V" configuration, creating a "special concentric braced frame" system.

Figure 3:
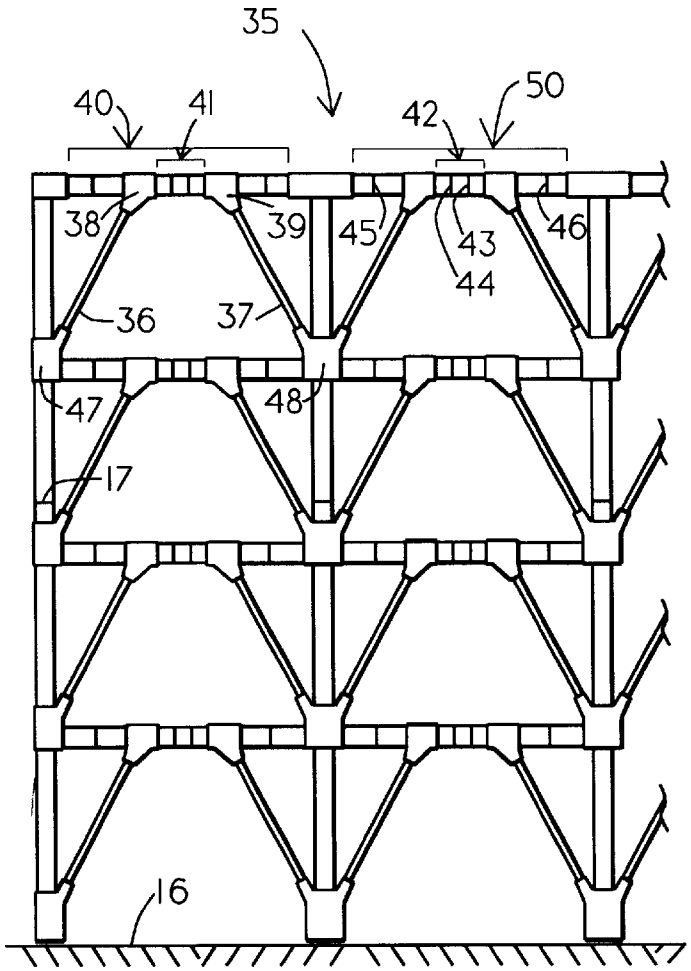
FIG. 3 is a partial, elevation view of the structural steel framework of a building, in which the other end of the diagonal braces are separately and eccentrically connected to a common beam.

FIG. 3 is a partial, elevation view of the structural steel framework 35 of a building, in which the upper ends of the diagonal braces 36 and 37 are separately connected by respective gusset plates 38 and 39, to a common beam 40. It is understood, of course, that each of the gusset plates shown, have a corresponding parallel gusset plate, (hidden behind the shown gusset plate), which is similarly connected to the brace, beam and column, on the opposite side of such brace, beam and column. Connecting diagonal braces 36 and 37 separately, or a distance apart, to beam 40, creates an "eccentric braced frame" system.

Link 41, which is the center portion of the beam 40, between gusset plates 38 and 39, functions as an "eccentric link" which yields in shear and bending and, thus, absorbs considerable energy, in the event of overloading by earthquake, wind, explosion or other disastrous event. "Links" are commonly known among structural steel design engineers, but have not been connected as shown herein, using parallel gusset plates on opposite sides of the beams and braces.

A similar link 42 in beam 50, may be seen to typically include vertical stiffeners 43 and 44, which, by quantity, that is, how many are used, and size are designed as part of the "eccentric link". Splice connections 45 and 46 are also typically shown in beam 50.

It is noted that gusset plates 38 and 39, as well as similar gusset plates in FIG. 3, connect only a brace to a beam and do not connect the brace and beam directly to a column, as do gusset plates 47 and 48.

Figure 9:
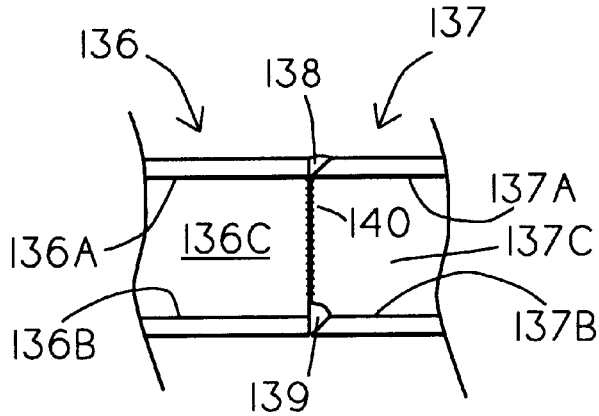
FIG. 9 shows the customary welded butt joint, (flange-to-flange and web-to-web), for connecting a stub beam to a link beam and for connecting stub brace to a link brace when the other end of the brace is welded to parallel gusset plates.

The splices shown, offer the opportunity to manufacture the connections in the shop, prefabricating sections of beam and, if desired, sections of column, with gusset plates attached. The manufactured section is then spliced into its proper frame location by welding or, in some instances, by bolts, or plates and bolts. If the braces are to be bolted to the gusset plates, it can be readily done in the field. If the braces are to be attached to the parallel gusset plates by welding, stub sections of the brace may be attached to the parallel gusset plates in the shop. Splicing in the remainder of the brace can then be done in the field. It should be understood that in any of the embodiments shown in the Figures herein, stub sections of the braces may be attached to parallel gusset plates in the shop and later be spliced to the remainder of the brace, in the field. Weld splicing as shown in FIG. 9 is the preferred form of splicing in a stub section of the brace to the remainder of the brace.

FIG. 3 illustrates braces 36 and 37 meeting at symmetrical locations along beam 40. In some structures, if designed properly, braces 36 and 37 may not be located symmetrical, but, rather, off center, so as to place link 41 other than at the center of beam 40, as shown in FIG. 3.

Figure 4:
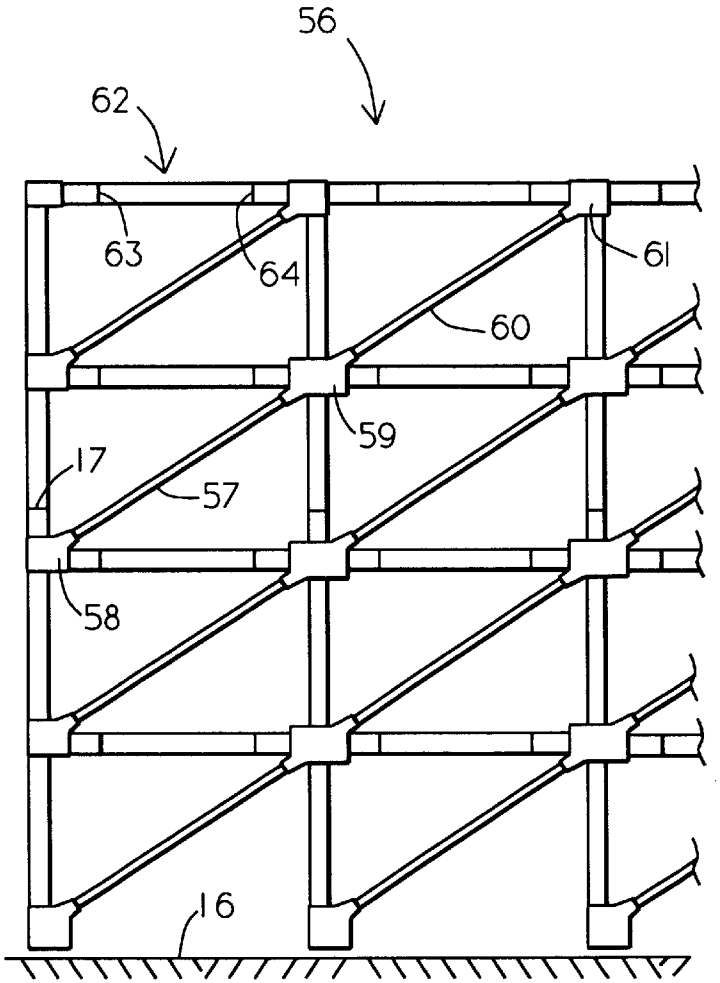
FIG. 4 is a partial elevation view of the structural steel framework of a building, in which the braces are all concentrically connected diagonally upwardly from left to right, from one beam-to-column connection to another beam-to-column connection. In some cases, the gusset plates connect the braces to only a column.

FIG. 4 is a partial elevation view of the structural steel framework 56 of a building, in which the braces 57, 60 and the like, are all connected diagonally upwardly from left to right, from one beam-to-column connection, gusset plate 58, (and its corresponding hidden gusset plate), to another beam-to-column connection, gusset plate 59, (and its corresponding hidden gusset plate), and then to beam-to column connection, gusset plate 61, (and its corresponding hidden gusset plate). It is noted that gusset plate 59 is a slightly different configuration than the other gusset plates, allowing for connections to braces 57 and 60 at opposite corners of gusset plate 59.

Beam 62 is shown as having two welded splice joints, 63 and 64, which allows manufacture of the gusset plates connection to a beam stub in the shop, under controlled conditions, which provides for better quality in the fillet welds. It is noted that the preferred embodiment connection of the brace to the gusset plates is by bolting. Consequently, the braces are readily and easily bolted in place, in the field, to assemblies manufactured in the shop.

Figure 5A:
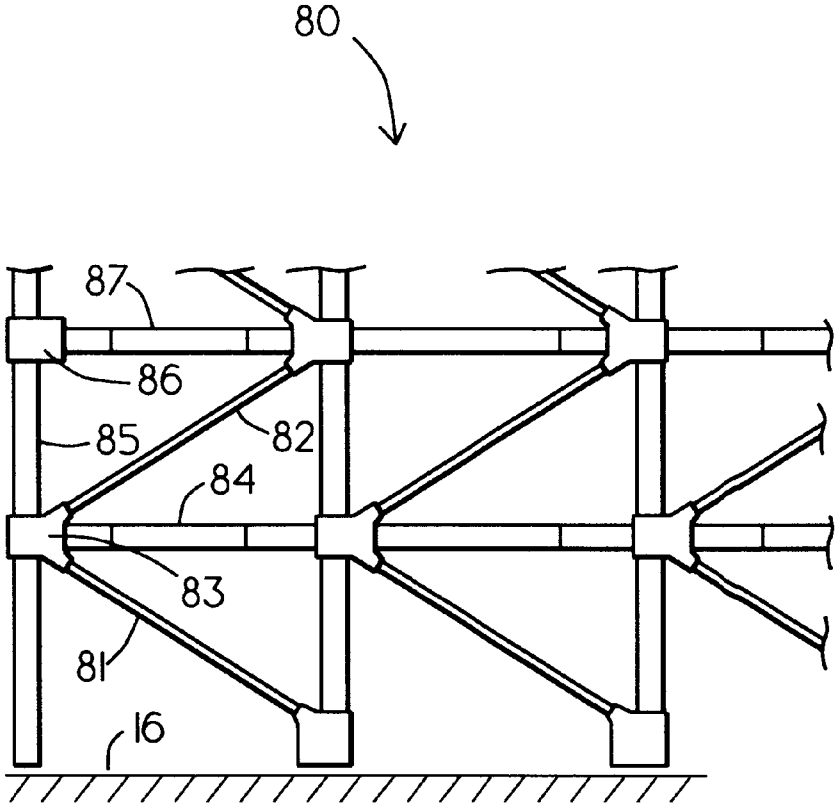
FIG. 5A is a partial elevation view on the structural steel framework of a building, in which two braces are commonly and concentrically connected to a beam-to-column connection, in "K" configuration.
Figure 5:
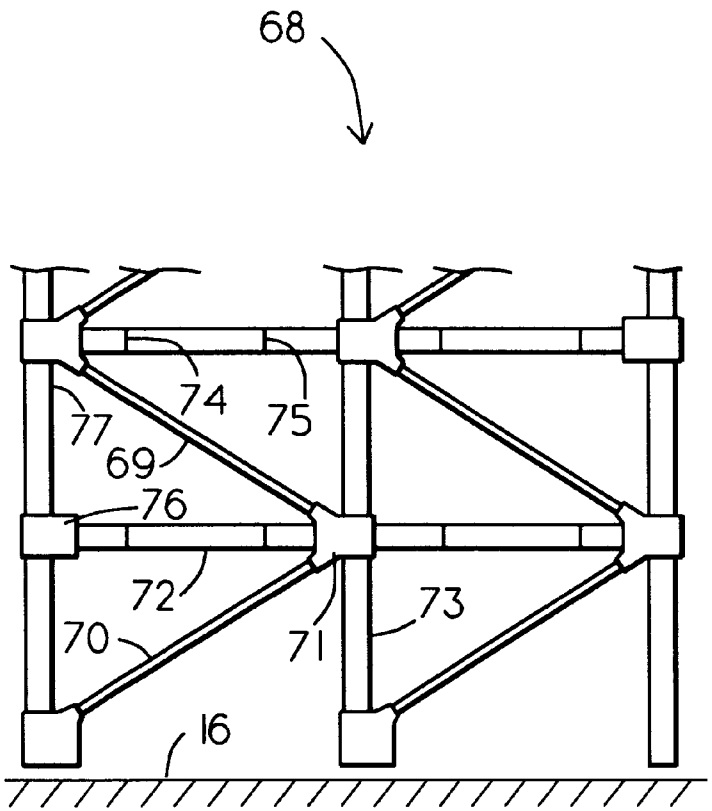
FIG. 5 is a partial elevation view of the structural steel framework of a building, in which two braces are commonly and concentrically connected to a beam-to-column connection, in reversed "K" configuration.

FIG. 5 is a partial elevation view of the structural steel framework 68 of a building, in which two braces, for example, braces 69 and 70 are commonly connected to a gusset plate 71 which, in turn, connects beam 72 to column 73, in reversed "K" configuration. Typical splice joints, welds, are shown at weld joints 74 and 75. It is noted that a gusset plate 76 connects beam 72 to column 77, in the manner taught in U.S. Pat. No. 5,660,017.

FIG. 5A is a partial elevation view on the structural steel framework of a building, in which two braces 81 and 82 are commonly connected to a gusset plate 83 which, in turn, connects beam 84 to column 85, in "K" configuration. Gusset plate 86 connects column 85 to beam 87, in the manner taught in patent U.S. Pat. No. 5,660,017. FIG. 5A is similar to FIG. 5 except that the reversed "K" configuration does not appear until the third floor. In FIG. 5, the lowermost braces, such as brace 70, commence in an upward direction to the right. In FIG. 5A, the lowermost braces, such as brace 81, commence in an upward direction to the left.

Figure 6:
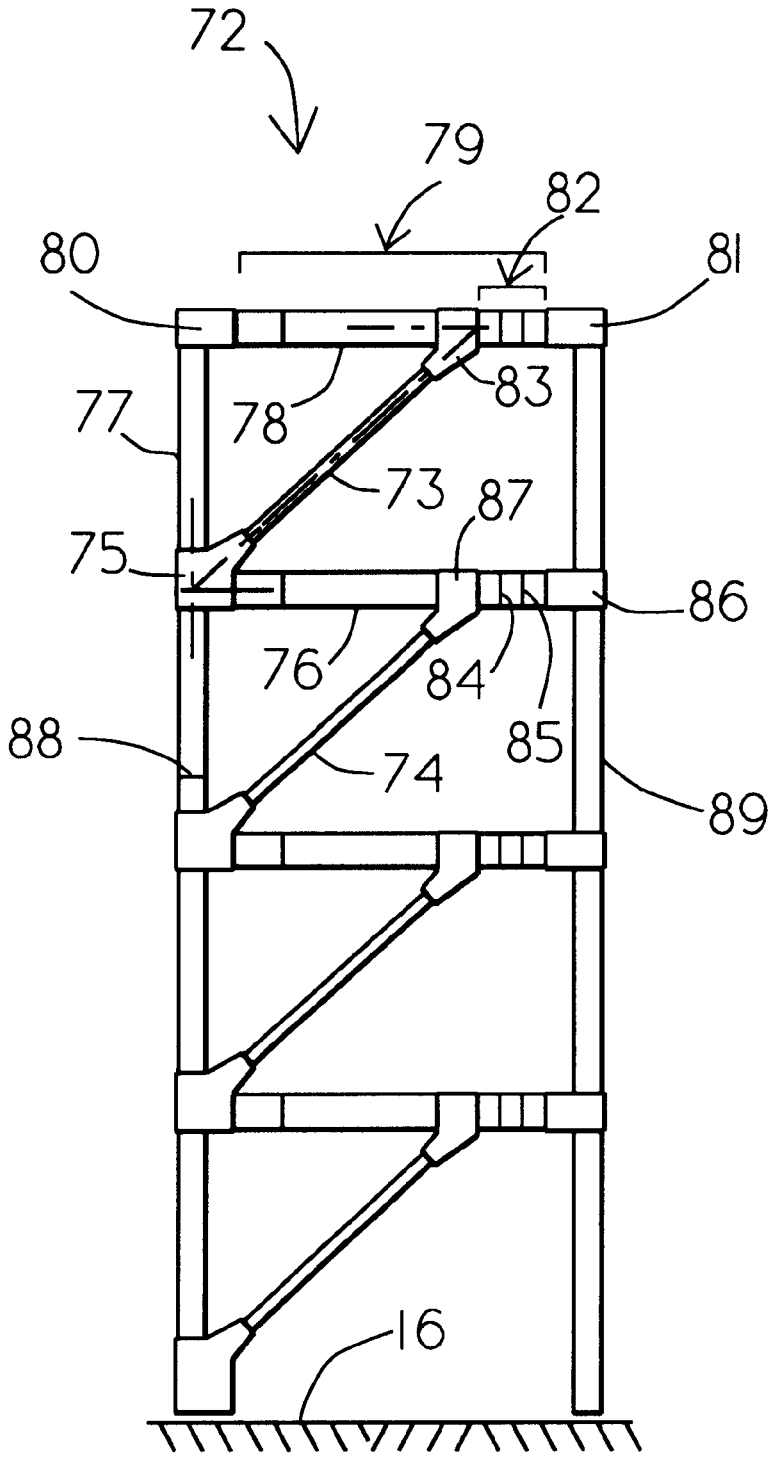
FIG. 6 is a a partial elevation view of the structural steel framework of a building, in which the braces are concentrically connected to a beam-to-column connection at one end, and are eccentrically connected, at their other end, a designed distance, "eccentric link" distance along the beam, away from the column centerline, necessary to permit absorption and dissipation of energy through shear and bending deformation of the "eccentric link".

FIG. 6 is a partial elevation view of the structural steel framework 72 of a building, in which the braces, for example brace 73 is connected, at its one end to column 77 and beam 76 by gusset plate 75, (and its corresponding hidden parallel gusset plate on the other side of column 77 and beam 76), and at its other end, to a beam 78, at a point other than at the center of beam 78 or at the end of beam 78. Brace 73 is connected to beam 78, in the embodiment of FIG. 6, by gusset plate 83, (and its corresponding hidden parallel gusset plate on the other side of beam 78), which gusset plate 83 is located at a designed distance from column 89, which creates an "eccentric braced frame" system. The length of beam 78 is approximated by length 79. This construction converts a portion of the beam into a special "eccentric link" which is capable of absorbing and dissipating considerable energy through shear and bending deformation when subjected to severe loading. The "eccentric link" portion of beam 78 is approximated by length 82.

A similar "eccentric link" portion is formed in beam 76 by brace 74 being connected to beam 76 through parallel gusset plate 87, (and its corresponding, hidden, parallel gusset plate on the other side of beam 76), at a designed distance from column 89. Vertical stiffener plates 84 and 85 are typically used as shown in the "eccentric link" portion of beam 76 and the remaining beams shown in FIG. 6. The quantity and size of such vertical stiffeners are determined and can be determined in the design of the "eccentric link", by skilled in the art structural engineers.

FIGS. 1–6 illustrate several concentric and eccentric bracing patterns. There are other patterns than those shown in FIGS. 1–6, to which the inventive concepts herein are readily applicable.

Figure 7:
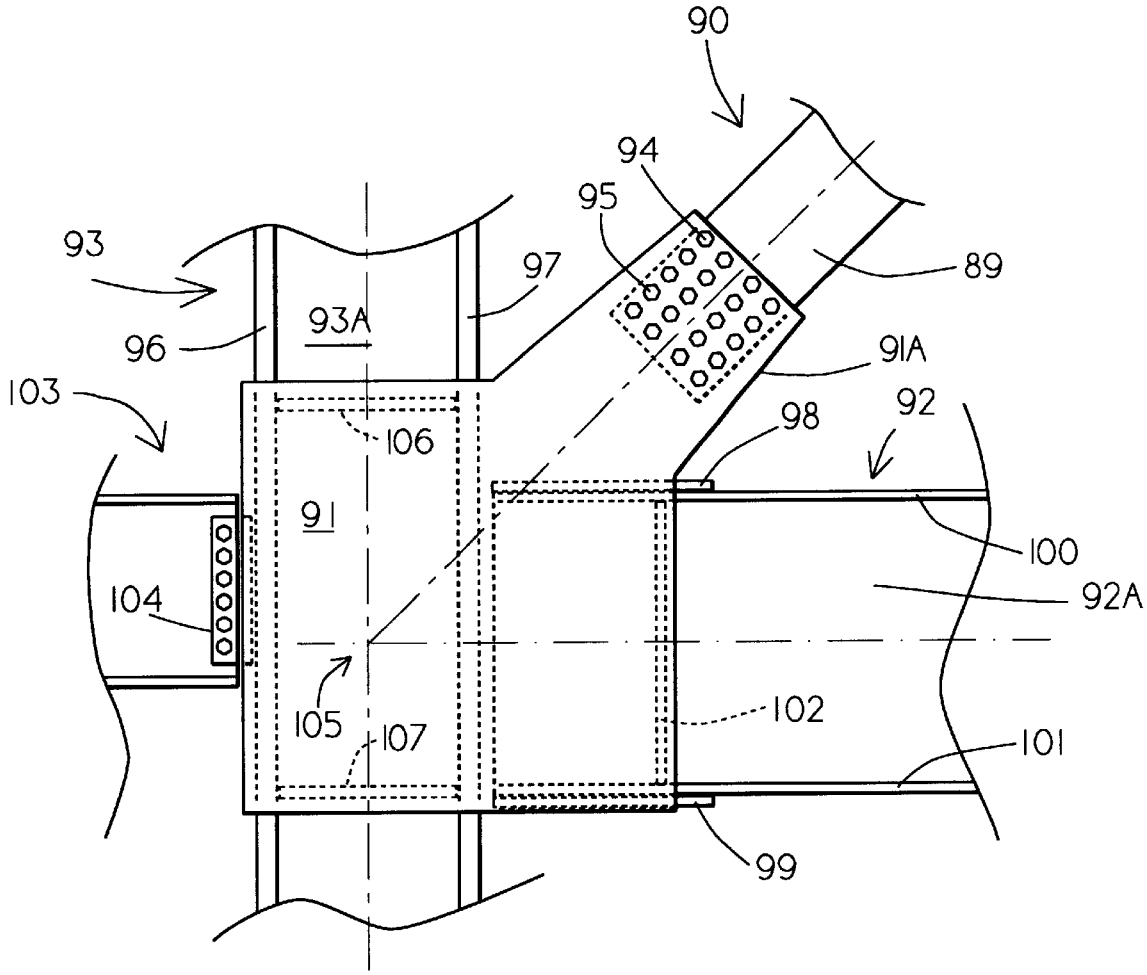
FIG. 7 is an illustration of one embodiment of a connection of a brace to a set of parallel gusset plates, (one of which gusset plates is hidden behind the other), showing concentric centerline location of brace, beam and column. Also shown is the bolting of one of the flanges of the brace to one of the gusset plates.

FIG. 7 is an illustration of a typical embodiment of the invention, in which one flange 89, the nearest flange, which is the only one visible, of brace 90 can be seen to be connected to an extension 91A of gusset plate 91 by means of bolts, such as bolts 94 and 95. It can also be seen that gusset plate 91 is connected to beam 92. In this embodiment, top cover plate 98 and bottom cover plate 99 are fillet welded to the flanges 100 and 101, respectively, of beam 92. In turn, cover plates 98 and 99 are fillet welded to gusset plate 91 and, of course, to its corresponding, hidden gusset plate on the other side of beam 92 and column 93. Gusset plate 91 is further fillet welded to the flanges 96 and 97 of column 93. The corresponding gusset plate, (not shown), on the other side of column 93 is similarly welded to the flanges 96 and 97 of column 93. Such cover plate welding to the beam and to the opposed, parallel gusset plates and the welding of the opposed, parallel gusset plates on opposite side of the column, are taught in patent U.S. Pat. No. 5,660,017. Alternately, such top and bottom cover plates 98 and 99 might be bolted, rather than fillet welded, to the top and bottom flanges 100 and 101, of the beam 92, but that is not a preferred construction.

It is to be noted that in the event the beam flanges are as wide as the column flanges, cover plates are not necessary, but, rather, the beam flanges can be directly fillet welded to the parallel gusset plates involved. Such is true of any of the beam connections with respect to the parallel gusset plates, described herein.

It is also noted that beam 92 does not have the end of its flanges 100 and 101 welded to flange 97 of column 93, which was the traditional method of connecting a beam to a column. Formerly, those flanges 100 and 101 were welded by complete penetration, groove welds, to flange 97. In high stress or overloading situations, wherein moments were placed on beams disposed similarly to beam 92, but in which their flanges were welded to the column flange, such welds were found to fail by cracking or, even, by pulling divots from the column flange.

Horizontal shear plates 106 and 107 are fillet welded to the web of column 91 and to the inside of the flanges of column 91, and to the gusset plates, such as gusset plate 91, to transfer shear loads from the gusset plates to the web of the column 91. Corresponding horizontal shear plates are similarly disposed and fillet welded on the other side of web 93A of column 93, directly opposite the horizontal shear plates 106 and 107. Horizontal shear plates may be located as shown, within the gusset plate 91, or, at other locations such as at the end of the gusset plate 91. If so located, the horizontal shear plates 106 and 107 would be wider, so as to extend farther outwardly from the column web, overlapping the end of the gusset plate 91. Then, the horizontal shear plate could readily be fillet welded to the gusset plate, horizontally along the outside of the overlap of the horizontal shear plate and the gusset plate 91. Of course, there are corresponding, similar horizontal shear plates on the other side of the web of beam 93, directly opposite horizontal shear plates 106 and 107.

Vertical shear plate 102 transfers vertical load from the beam 92 to the column 93 through the gusset plate 91. The vertical shear plate 102 is fillet welded to the beam web 92A and beam top and bottom flanges 100 and 102 and, also, is fillet welded to the gusset plate 91. This is previously taught in patent U.S. Pat. No. 5,660,017. There is, of course, a corresponding vertical shear plate, (not shown), symmetrically located on the opposing side of web 92A, directly opposite from vertical shear plate 102, which corresponding vertical shear plate is similarly fillet welded to the flanges and web of beam 92 and the hidden gusset plate.

In summary, as to the corresponding gusset plate, (not shown), on the opposite side of the brace 90, beam 92 and column 93, the corresponding gusset plate, (not shown),is similarly connected to brace 90, beam 92 and column 93 as is gusset plate 91.

Hidden vertical shear plate 102 is shown located just inside gusset plate 91. It may be located elsewhere, for example, just outside gusset plate 91, in which location, the vertical shear plate 102 would likely be made wider so as to overlap the ends of gusset plate 91 and be readily fillet welded thereto along the vertical line where the vertical shear plate 102 overlaps the end of gusset plate 91. Said vertical shear plate, of course, would also be welded to flanges and web of beam 92. The corresponding horizontal shear plate on the opposite side of web 92A would be similarly connected and lie directly opposite from vertical shear plate 102.

It is possible to design systems not requiring horizontal and vertical shear plates, but the preferred structure and the most used structure, includes horizontal shear plates in the columns, and vertical shear plates in the beams.

A smaller beam 103, used for carrying gravity loads and axial drag forces, is shown extending from column 93. Shear tab 104 is bolted to the web of beam 103 and is welded to the flange 96 of column 93. Such smaller beam has no particular significance with respect to this invention and is only an example of the variety of connections which may be made between beams and columns in a building structure.

FIG. 7 also shows the location and direction of the centerlines, or axial lines, of the brace 90, beam 92 and column 93. It is noted that such centerlines typically intersect concentrically at a common intersection point 105. "Concentric", in this instance, means the centerlines intersect at a common point.

Figure 8:
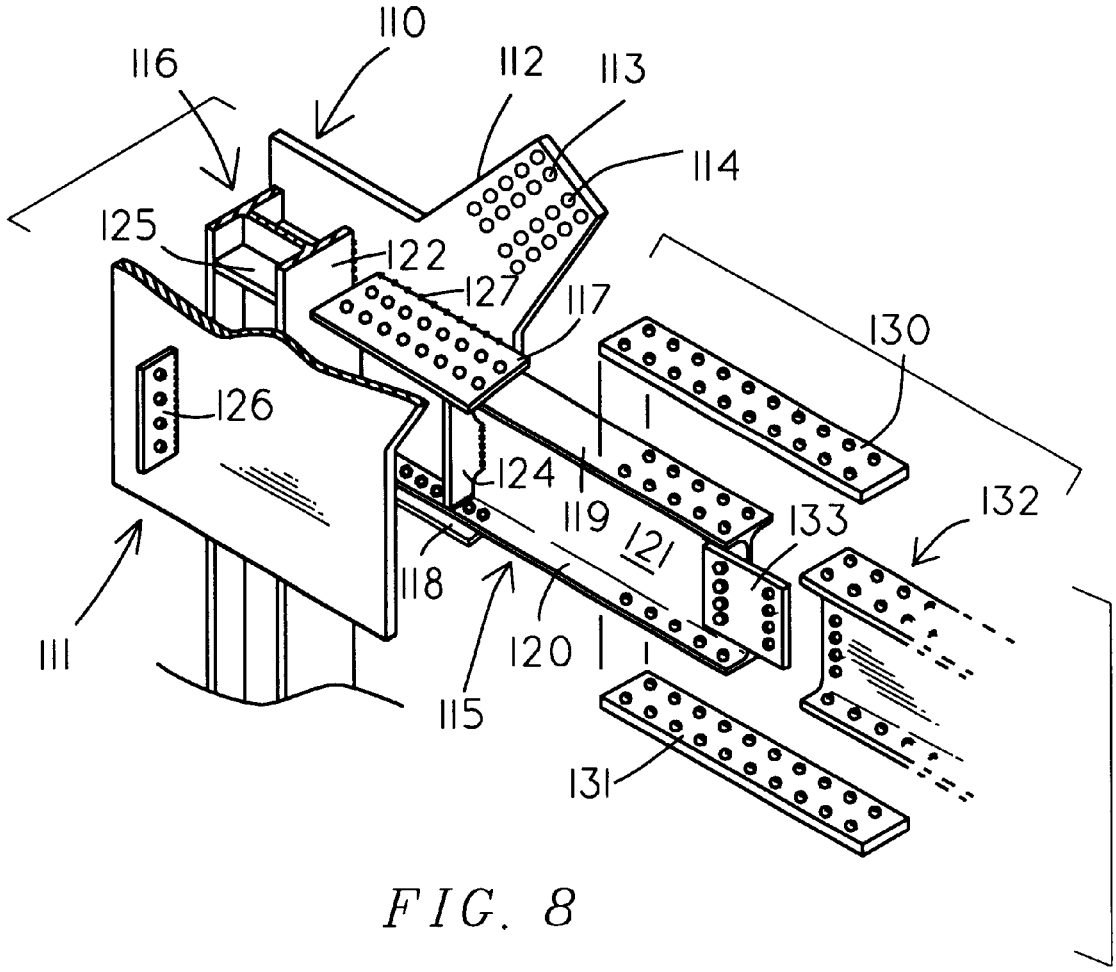
FIG. 8 is an exploded, isometric drawing showing parallel gusset plates, (one of which is partially cut away), column, beam and one gusset plate extension for connection to one flange of a brace.

FIG. 8 is an exploded, isometric drawing showing gusset plates 110 and 111 on opposing sides of a stub beam 115 and column 116. Gusset plate 111 is partially cut away to better show the structure. Both gusset plates 110 and 111 have an extension, such as extension 112 of gusset plate 110, for connecting to a brace (not shown) by bolts through the bolt holes such as bolt holes 113 and 114.

When the flange width of stub beam 115 is less than the flange width of column 116, the stub beam 115 is fixedly attached with respect to column 116 through cover plates 117 and 118, which are shown to be bolted to the flanges 119 and 120, respectively of stub beam 115. Preferably, such cover plates 117 and 118 would be fillet welded to the flanges 119 and 120 of stub beam 115, but bolting is an alternative.

Cover plates 117 and 118 are further fillet welded along their edges to gusset plates 110 and 111 by fillet welds, such as shown along fillet weld line 127, which gusset plates, in turn, are fillet welded to the flanges of column 116, thus fixedly attaching stub beam 115 with respect to column 116. Further, the web 121 of beam 115 is shown attached to the flange 122 of column 116 by shear tab 123, which is bolted to web 121 and fillet welded to flange 122.

When the flange width of stub beam 115 is the same as the flange width of column 116, the need for cover plates 117 and 118 is eliminated and stub beam 115 is fixedly attached with respect to column 116 directly by fillet welding flanges 119 and 120 to parallel gusset plates 111 and 110.

Beam 115 is strengthened by a vertical shear plate 124. The vertical shear plate 124 is welded to web 121, flanges 119 and 120 and to gusset plate 111, preferably, by fillet welds. A corresponding vertical shear plate (not shown) is similarly attached on the opposite side of web 121, directly opposite vertical shear plate 124. Such vertical shear plates transfer vertical load from the beam 115 through gusset plates 110 and 111 to column 116.

Column 116 is shown strengthened by horizontal shear plates, such as horizontal shear plate 125.

Vertical shear tab 126, fillet welded to gusset plate 111 shows how a typical gravity load-carrying beam (not shown) might be connected to column 116 from the side of gusset plate 111. The vertical shear tab is shown adapted to be bolted to the web of such a beam.

Stub beam 115 is shown to be connected to a continuation beam, (link beam), 132 by means of splice plates 130 and 131, which are shown to be bolted to flanges 119 and 120, respectively, and to the flanges of link beam 132. Vertical shear tab 133 is shown adapted to be bolted to the web 121 of beam 115 and the web of beam 132. Connection of stub beam 115 to a link beam 132 may well be by welding, as discussed with respect to FIG. 9 hereafter, rather than bolted or welded splice plates.

FIG. 9 shows a customary weld technique for splice connecting a stub beam, such as stub beam 136 to a link beam 137. FIG. 9 also represents a splice connection of a stub brace to a link brace, in those instances wherein the end of the brace is welded to a set of parallel gusset plates. It is to be appreciated that such welded link beam splices and link brace splices may be used the embodiments shown and discussed with respect to FIGS. 1–6.

In FIG. 9, it may be seen that the flange 137A of beam 137 is beveled to permit a complete penetration groove weld to be deposited between flange 136A of beam stub 136 and flange 137A of link beam 137. Similarly, the bottom flange 137B of beam 137 is beveled, which requires a weld access hole in web 137C, to permit a weld deposition between flange 136B and flange 137B. Web 136C and web 137C are likewise joined using a complete joint penetration groove weld 140, by beveling the edge of the web 137C, to complete the splicing of a stub beam 136 to a link beam 137. This is the customary practice. The beveling of beam flanges 136A and 136B and beam web 136C may alternately be done on beam stub 136.

Figure 10:
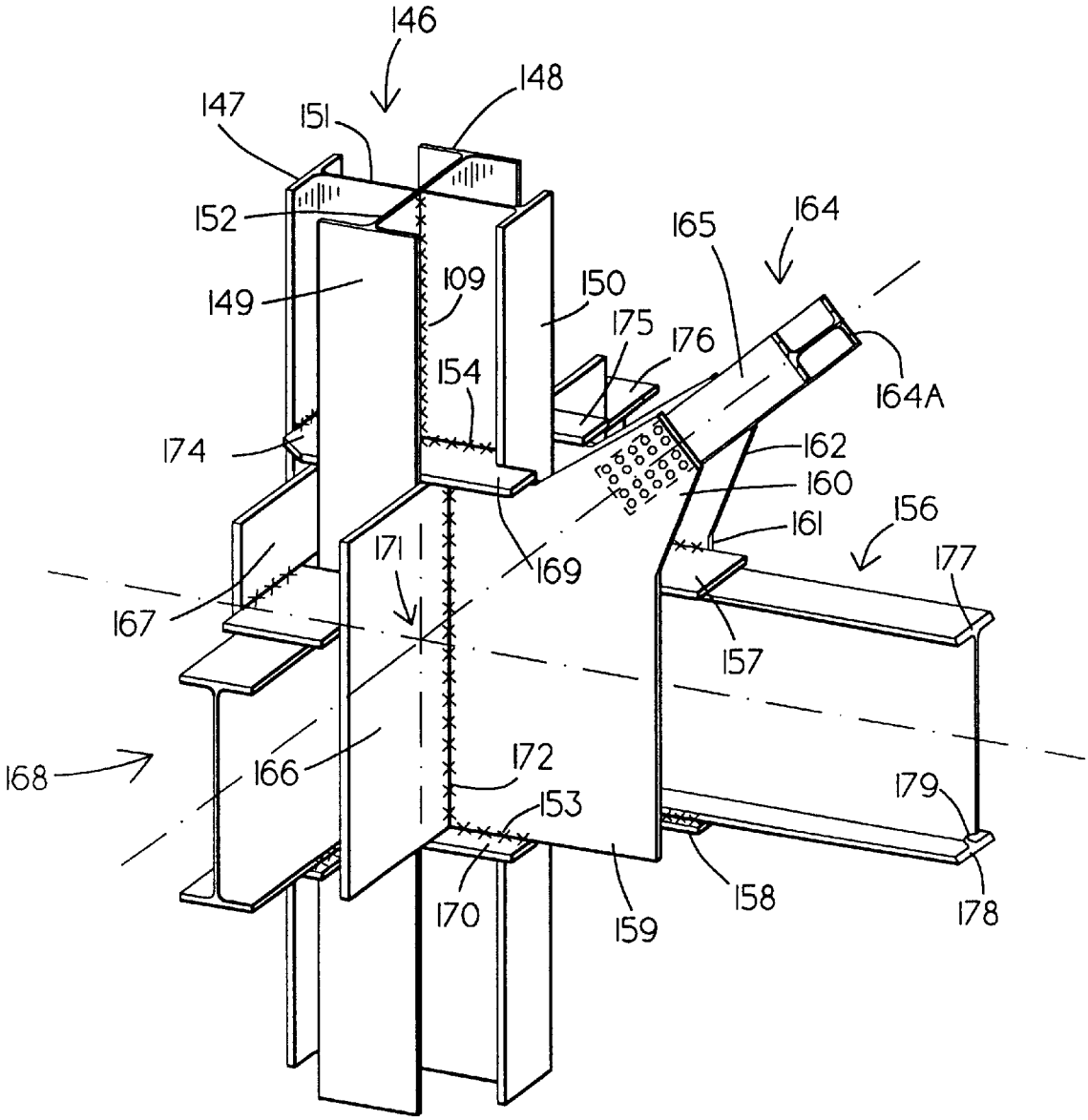
FIG. 10 shows a dual axes cruciform column having four flanges and two intersecting webs. It further shows a section of a brace whose flanges are bolted to parallel gusset plates which are further fixedly attached with respect to the column flanges and to an orthogonal set of two parallel gusset plates and to a beam. The parallel gusset plates are further fixedly attached to a pair of horizontal shear plates, sometimes referred to as "flag plates", because of their extend length beyond the flange of the cruciform column.

FIG. 10 shows a built-up dual axes column 146, having four flanges 147, 148, 149 and 150, and two mutually orthogonal, intersecting webs 151, 152, in cruciform shape. It further shows a section of a brace 164 whose flange 165 can be seen to be bolted (or riveted) to an extension 160 of gusset plate 159, which is further fixedly attached with respect to the column flange 150 by being fillet welded, (hidden), thereto along the edge of flange 150. Of course, the flange 164A on the far side of brace 164 is similarly bolted (or riveted) to extension 162. It is to be understood that the flange 164A, similarly to flange 165, is fixedly attached, through a gusset plate, (gusset plate 161), to the flange 150.

Gusset plate 159 is further welded by fillet weld to gusset plate 166, along weld line 172. Similar to previously discussed beam connections, beam 156 is fixedly attached with respect to the column 146, through cover plates 157 and 158, which in this embodiment are be fillet welded to both beam and gusset plates.

Weld 154 connects flag plate 169 to the web 151 of column 146. Column 146 is constructed by welds such as weld 109 between crossing webs 151 and 152. Various other welds may be seen in FIG. 10, such as a weld between plate 174 and flange 147 and between bottom cover plate 158 and the bottom flange of beam 156.

Flag plates 169 and 175, and cooperating plates, such as plate 174, acting collectively as horizontal shear plates, are disposed within the flanges of column 146 and are fillet welded to the webs and flanges of column 146, to provide greater strength in the column. Such flag plates and cooperating plates are horizontal shear plates, as taught in patent U.S. Pat. No. 5,660,017. Flag plate 169 is fillet welded to the top edge of gusset plate 159; and flag plate 175 is fillet welded to the top edge of gusset plate 161, which is on the other side of the beam 156. It can easily be seen how flag plates 169 and 175 provide additional attachment between the column 146 and the parallel gusset plates 159 and 161. This is because flag plates 169 and 176 extend a distance along the top of parallel gusset plates 159 and 161 and provide a longer line along which to form a weld between the flag plates 169 and 176 and the parallel gusset plates 159 and 161.

Similar flag plates and cooperating plates (not shown) would be disposed below and fillet welded to the bottom edges of the gusset plates 159 and 161, as may be seen by flag plate 170 and weld line 153, which are visible. Weld line 153 is a typical one of those longer lines along which a weld is formed between the flag plates and the parallel gusset plates.

Gusset plate 166 extends through a slot, (not shown), vertically cut, in web 151. Similarly, gusset plate 167 extends through another slot, (not shown), vertically cut in web 151. Thus, gusset plates 166 and 167 are continuous through the connection and act as primary gusset plates. Such primary gusset plates 166 and 167 allow additional beams to be connected to column 146, such as beams 168 and 176, through the use of cover plates and fillet welds, as previously described and as described in patent U.S. Pat. No. 5,660,017.

It can be seen that the cruciform, dual axes construction permits parallel gusset plate connections to beams in a two-sided, corner configuration, (two beams mutually orthogonal to each other), a three-sided configuration, as shown in FIG. 10, or a four-sided configuration, with four beams being connected to a single cruciform column. To connect a beam in a fourth direction, opposite beam 156, would simply require symmetrically repeating the construction which connects beam 156.

If such a beam were constructed, opposite beam 156, in similar fashion, its parallel gusset plates could have extensions similar to extensions 160 and 162 of parallel gusset plates 159 and 161, to receive a diagonal brace similar to diagonal brace 164.

It can also be seen that the cruciform, dual axes construction also permits the parallel gusset plates 166 and 167, to have extensions similar to extension 160 and 162 of parallel gusset plates 159 and 161, and a diagonal brace could then be received from another direction.

It is also to be understood that the parallel gusset plates 159 and 161 might be constructed to have extensions downwardly, to receive a brace from below the beam 156. So, too, could a similar pair of parallel gusset plates opposite parallel gusset plates 159 and 161. Similarly, parallel gusset plates 166 and 167 could also have extensions downwardly to receive a brace from below the beam 168.

Thus, 8 braces, or any combination of one or more thereof, could be connected to such a cruciform, dual axes joint connection.

The axes of the brace 164, beam 156 and column 146 all pass through a common intersection 171, creating a "special concentric braced frame" system.

Beam 156, which is shown as a stub beam, is shown adapted to be splice welded to a continuation beam or a "link" beam, by having its flanges beveled, at bevels 177 and 178 and by a weld access hole 179 in the web of beam 156. Alternately, the beveling of beam flanges and beam web could be done on the end of the link beam, which is to be attached to stub beam 156.

Figure 11:
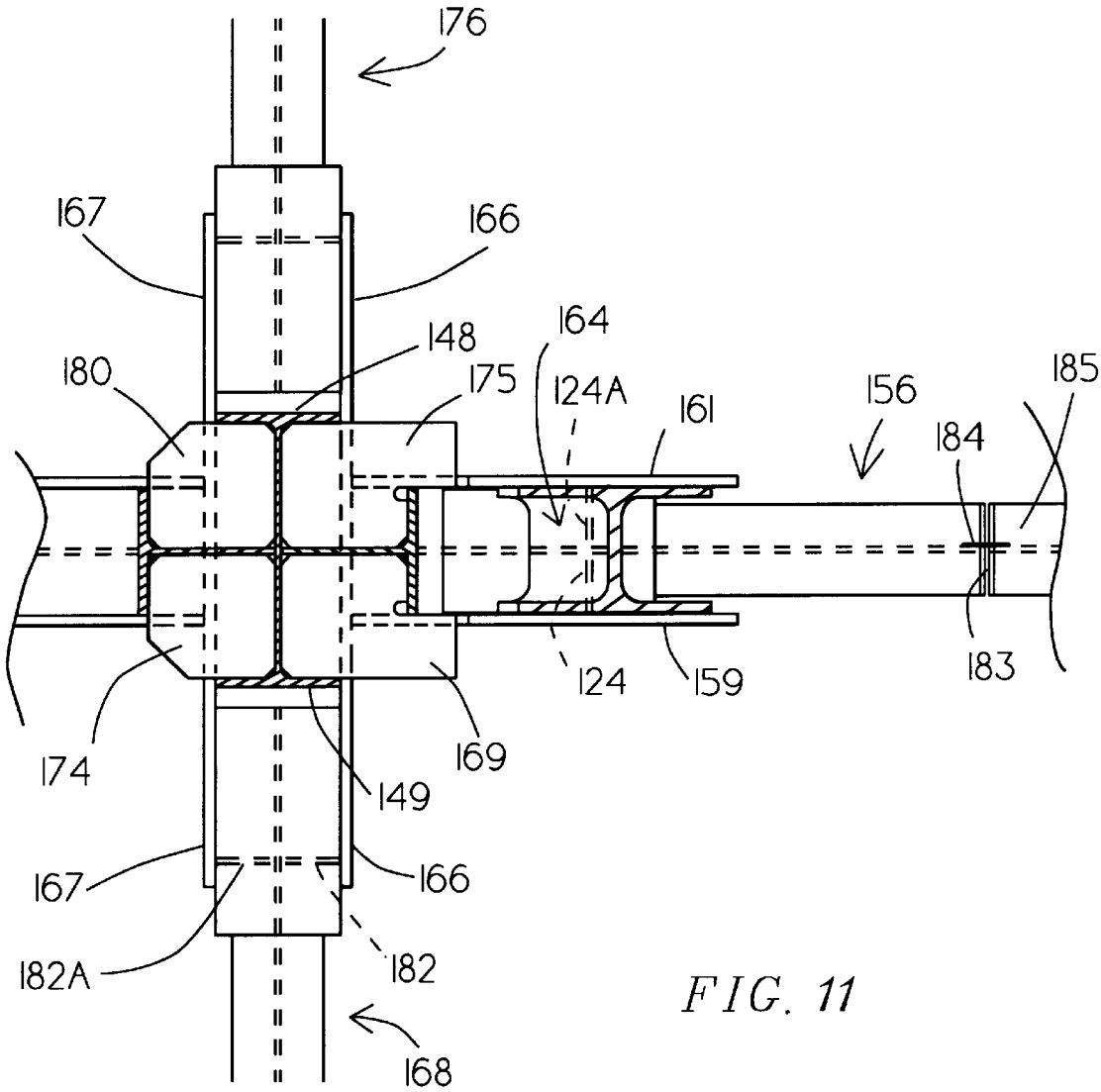
FIG. 11 is a plan view of a dual axes column, showing a brace, cut away, connected to parallel gusset plates. Further shown are two flag plates having two additional continuation plates, which collectively constitute four horizontal shear plates within the core of the cruciform column.

FIG. 11 is a plan view of the dual axes, cruciform column of FIG. 9, having flanges shown in section, for example, flanges 148 and 149, and showing a diagonal brace 164, in section, which diagonal brace 164 would be attached (bolted, riveted or welded) with respect to gusset plates 159 and 161. Further shown are the flag plates 169 and 175, having two cooperating plates 174 and 180. Vertical shear plate 124, (hidden, but shown by dotted lines), disposed in beam 156, is better understood by reference to vertical shear plate 124 in FIG. 8. A symmetrical vertical shear plate 124A, (hidden, but shown by dotted lines), is disposed on the opposite side of the web of beam 156. Similar vertical shear plates, such as vertical shear plates 182 and 182A, (hidden, but shown by dotted lines), are similarly disposed in beam 168.

Splice weld joint 183, connects stub beam 156 to beam 185 which may be either a continuation or a "link" beam. Shear tab 184 connects the web of beam 156 to the web of beam 185.

Figure 12:
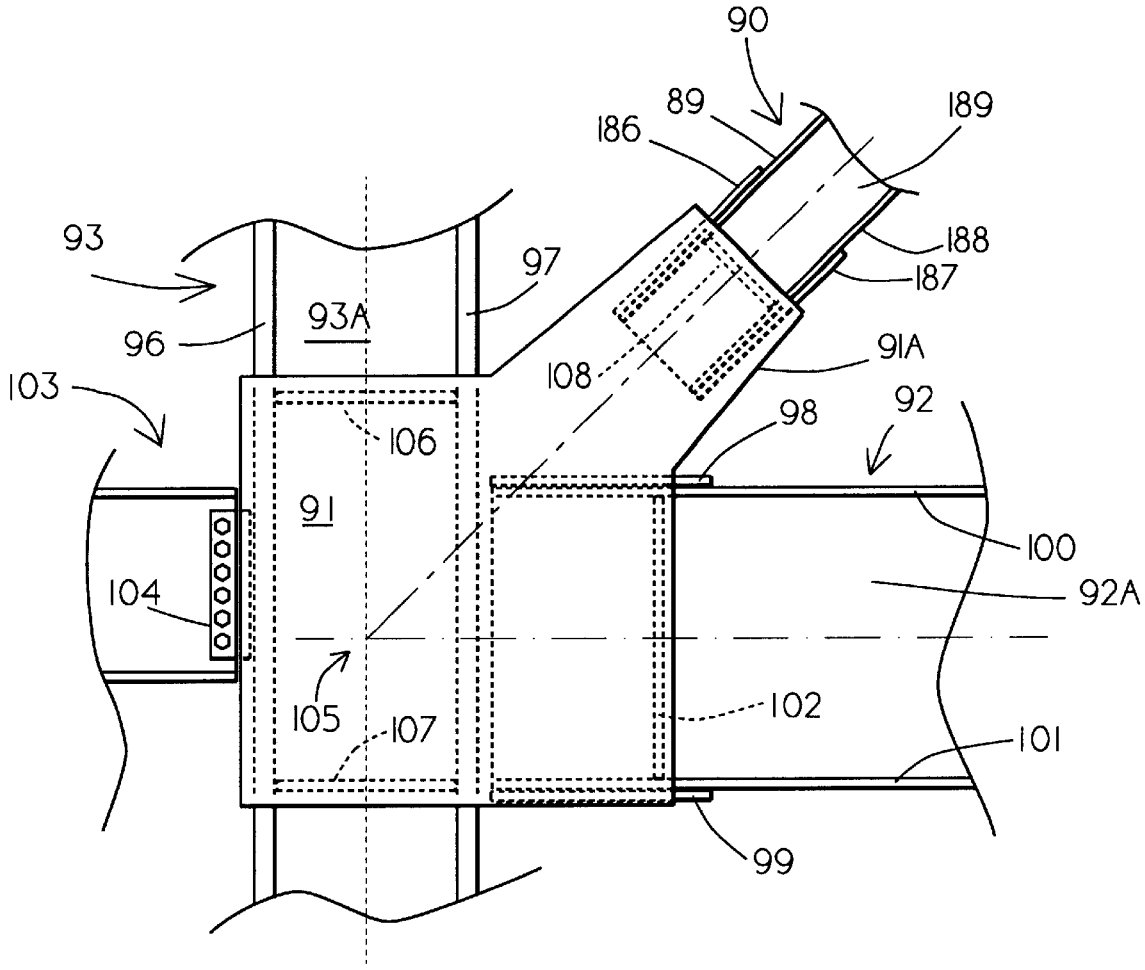
FIG. 12 is an illustration of another embodiment of a connection of a brace to a set of parallel gusset plates, (one of which gusset plates is hidden behind the other), in which the brace is rotated 90 degrees and is fixedly attached with respect to the gusset plates by being fillet welded, rather than bolted.

FIG. 12 is an illustration of another embodiment of a connection of a brace 90 to a set of gusset plates, such as gusset plate 91, (the corresponding opposite gusset plate being hidden behind plate 91), in which the diagonal brace 90 is rotated 90 degrees so that its flanges 89 and 188 can be seen to be interconnected by web 189. Brace 90 is fixedly attached with respect to the extensions of the two parallel gusset plates, such as extension 91A, by being welded, rather than bolted. Cover plates 186 and 187, fillet welded to the flanges 89 and 188, respectively, of brace 90, are further welded to the extensions of the gusset plates, such as extension 91A. Alternatively, cover plates 186 and 187 could be bolted to the flanges 89 and 188 of brace 90.

It is to be understood that in the event the brace flanges are as wide as the column flanges, cover plates are not necessary, but rather, the brace flanges can be directly fillet welded to the parallel gusset plates involved. Such is true of any of the brace connections with respect to the parallel gusset plates, described herein.

The remaining structural elements, in FIG. 12, are the same as in FIG. 9 and are numbered the same. It is noted that horizontal shear plates 106 and 107 are welded to the web 93A and to the flanges 96 and 97 of column 93, as in FIG. 7. Corresponding horizontal shear plates are similarly disposed and welded on the other side of web 93A, directly opposite shear plates 106 and 107, as explained previously. Also, as explained previously, the horizontal shear plates may be located, in certain designs, at other locations within column 93.

In this embodiment, a shear plate 108 is similarly disposed and welded to the web 189 and flanges 89 and 188 of brace 90 and thence to the extension 91A of gusset plate 91. A corresponding shear plate (not shown) is similarly disposed and welded on the other side of web 189 of brace 90, directly opposite shear plate 108. Just as with the vertical shear plate 102, structural systems may be designed not needing shear plates such as 108, but in most instances and, preferably, such shear plates are included. As with the other shear plates, shear plate 108 and its corresponding hidden shear plate may be placed at other locations on the brace 89, such as, for example, overlapping the end of gusset plate extension 91A. The shear plate 108 would be made slightly wider, so as to overlap the end of gusset plate extension 91A. Shear plate 108 and gusset plate extension 91A would be welded together along their line of contact, which would be perpendicular to brace 90.

As discussed previously structural systems may not require shear plates, such as the shear plates in brace 90, but, the preferred brace structure includes shear plates. However, when a brace is bolted to the gusset plates, (extensions of the gusset plates), shear plates are not likely to be needed.

Turning the brace 90 in this manner and connecting it by welds to the gusset plates, provides a substantial increase in moment-resistance by the brace, then when it is connected by bolting and oriented as shown in FIG. 7.

A particular feature of the structure in FIG. 12 is that the fillet welds, between cover plates 186 and 187, which fixedly attach the brace 90 with respect to the column 93, is that the length of such fillet welds is configured and oriented parallel to the direction of the axial load that is carried by the brace.

This embodiment, shown in FIG. 12, is an especially important one because the connection of the brace to the column closely follows the concept and structural design philosophy of the manner in which the beam is fixedly attached with respect to the column.

In this manner, the full capacity of the brace is developed, both in bending moment and in axial load.

Figure 13:
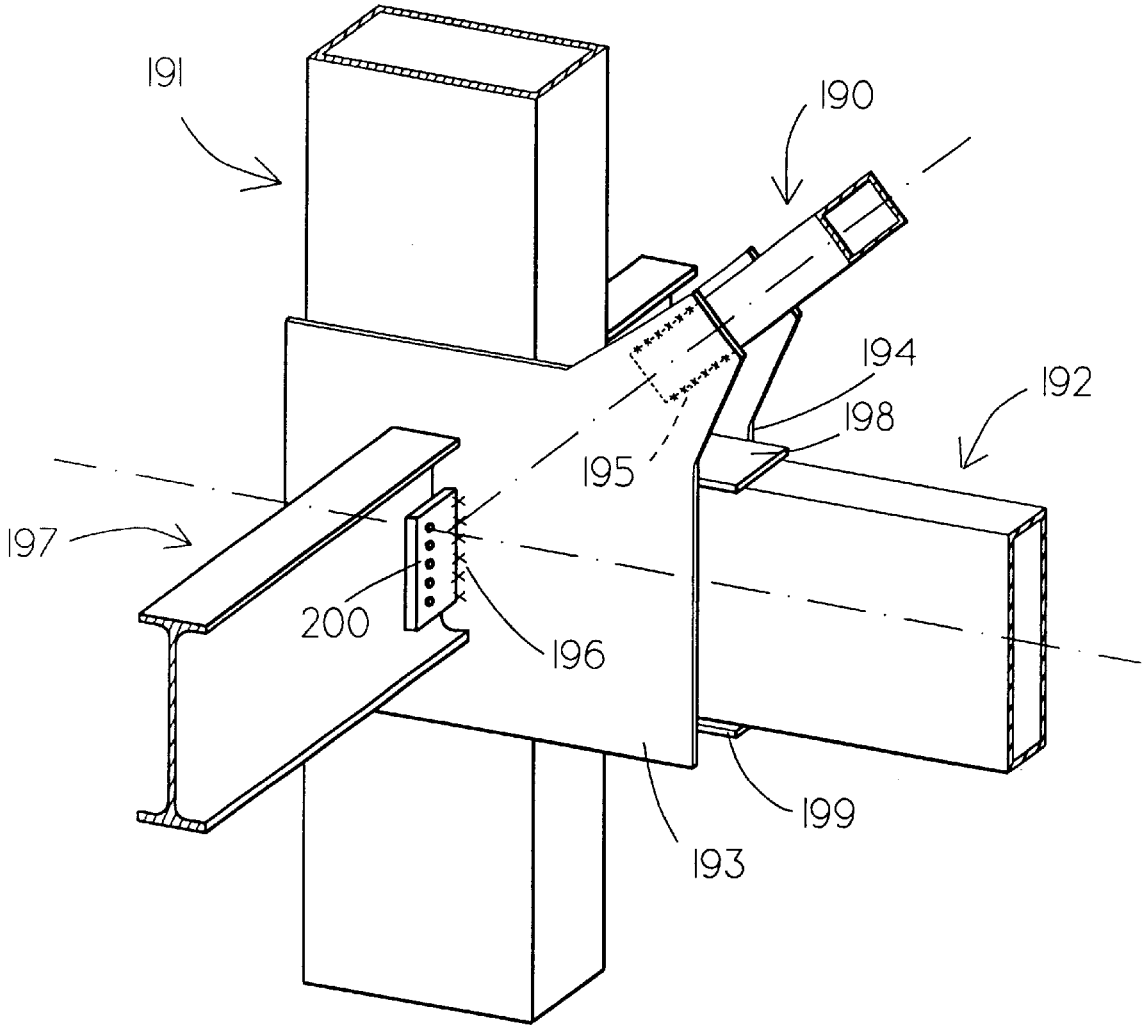
FIG. 13 is an illustration of another embodiment of a connection, using a box brace, a box beam and a box column.

FIG. 13 is an illustration of a connection, showing a box brace 190 connected by fillet welds, such as hidden fillet weld 195, to extensions of gusset plates 193 and 194, which gusset plates, in turn, are fillet welded to box column 191. Box beam 192 is attached through cover plates 198 and 199 to gusset plates 193 and 194 and, therefore, is fixedly attached with respect to box column 191. Beam 197 is a typical gravity load-carrying member, and is shown connected by a shear tab 200 to gusset plate 193. Shear tab 200 is welded to gusset plate 193, by weld 196, and bolted or riveted to the web of beam 197. Shear tab 200 may also be welded to the web of beam 197. The flanges of beam 197 are not welded to gusset plate 193.

FIG. 13 illustrates that other structural shapes than the "H" structure of a brace, column or beam, can be used in carrying out the invention. That is, alternatively, the connection can be used with any combination of "H" or tube or box sections serving as either a column, brace or beam.

It is important to understand that horizontal shear plates, (commonly referred to as "internal diaphragm plates" in the construction of built-up box columns and tube steel columns), are not required when using parallel gusset plate technology. This is so because the webs of a box shape and of a tube shape are fixedly attached directly to the face of each parallel gusset plate. This is, in turn, a significant factor in reducing construction costs.

Figure 14:
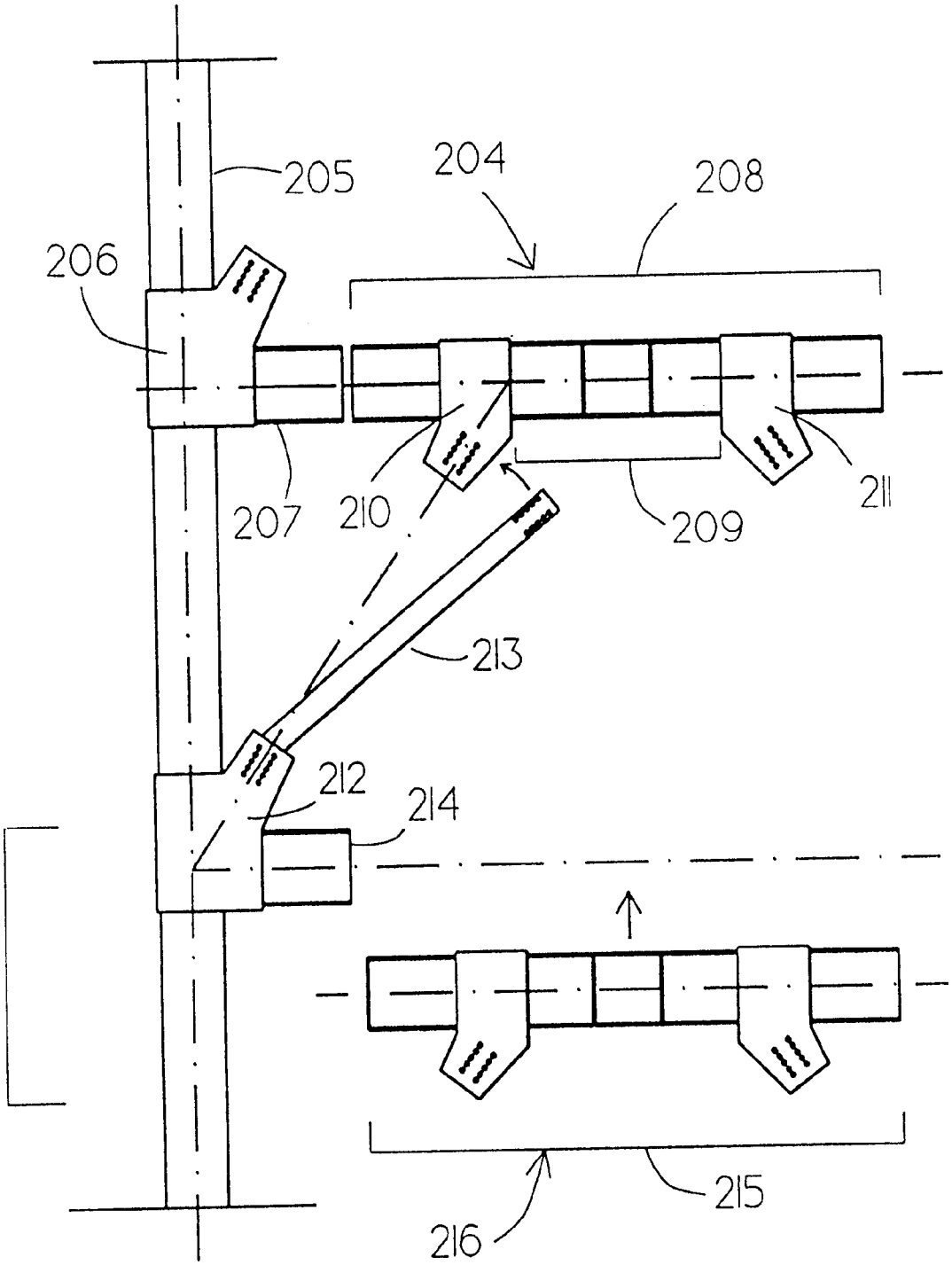
FIG. 14 is an elevation sketch, showing field assembly of column, beam, brace and using improved, parallel gusset plate technology of this invention.

FIG. 14 is an elevation sketch, showing a column 205 having constructed thereon a first pair of parallel gusset plates, represented by parallel gusset plate 206. The other, corresponding, parallel gusset plate is hidden behind parallel gusset plate 206 and is disposed on the other side of column 205. Stub beam 207 has already been attached to parallel gusset plate 206 and its corresponding parallel gusset plate, on the opposite side of column 205 and to the column 205, as well. It is to be noted that the completed column assembly, consisting of column, two sets of parallel gusset plates and corresponding beam stubs and corresponding brace stubs, (as applicable), is commonly referred to as "column tree" construction in the steel frame industry. Beam 204, having a length 208 is in the process of being assembled in the field, by being welded to stub beam 207, as previously described herein. "Eccentric link" 209, which is a portion of beam 208, is shown to lie between a pair of parallel gusset plates, only gusset plate 210, of the pair, being visible, and another pair of parallel gusset plates, only gusset plate 211, of the pair, being visible. Brace 213 is in the process of being swung into place for final bolting at each end, one end to a pair of parallel gusset plates, only gusset plate 212, of the pair, being visible, and final bolting of the other end of the brace to another pair of parallel gusset plates, only gusset plate 210, of the pair, being visible.

Also shown in the process of being assembled is beam 216, which is of a length 215 which is to be welded to stub beam 214, when raised into position. It is likely that beam 215 would be welded in place before beam 208, construction usually working from the ground up.

Although specific embodiments and certain structural arrangements have been illustrated and described herein, it will be clear to those skilled in the art that various other modifications and embodiments may be made incorporating the spirit and scope of the underlying inventive concepts and that the same are not limited to the particular forms herein shown and described except insofar as determined by the scope of the appended claims.

I claim:

1. A structural joint comprising a column disposed as permanent, columnar support of a structure, such as a building, tower and similarly heavy structure, said column having at least two flanges, a beam having two ends, one end disposed near said column and the other end disposed away from said column, a diagonal brace having two ends, one end disposed near said column and the other end disposed away from said column, wherein said structural joint is comprised of two gusset plates disposed in parallel relationship on opposite sides of at least one of said flanges of said column, wherein said gusset plates are in face-to-face relationship with respect to each other, wherein one of said gusset plates extends along one side of said beam and along one side of said diagonal brace;

wherein the other of said gusset plates extends along the other side of said beam and along the other side of said diagonal brace, wherein each of said gusset plates is connected to said column by being welded to at least one of said flanges of said column, wherein each said welded connection extends along said at least one flange of said column and each said gusset plate, a distance sufficient to resist severe loads on said welded connection, such as those severe loads, beyond normal gravity loading, caused by one or more disastrous events, such as earthquakes, tornadoes, hurricanes, high winds, blasts, explosions and the like, wherein each of said gusset plates extends substantially beyond said column flange to which it is welded, in the general direction of another flange of said column, wherein each of said gusset plates is fixedly attached with respect to said beam by a connection sufficiently strong to resist severe loads, on said connection between said gusset plates and said beam, such as those severe loads beyond normal gravity loading, such as severe loads caused by one or more of earthquakes, tornadoes, hurricanes, high winds, blasts, explosions and the like, wherein each of said gusset plates is fixedly attached with respect to said diagonal brace by a severe moment-resisting connection, wherein said latter moment-resisting connection resists severe moment loads, on said latter moment-resisting connection, such as those severe moment loads beyond normal gravity loading and caused by one or more of earthquakes, tornadoes, hurricanes high winds, blasts, explosions and the like.

2. The structural joint of claim 1, wherein each of said gusset plates extends along the sides of said diagonal brace by an extension which extends diagonally away from said column and said beam, and wherein said severe moment-resisting connection fixedly attaching said gusset plates with respect to said brace, is disposed between said brace and said extensions of said gusset plates.

3. The structural joint of claim 2, wherein said severe moment-resisting connection, disposed between said brace and said gusset plates, is comprised of several rows of fasteners, each row having several fasteners connecting said brace to said gusset plates.

4. The structural joint of claim 2 wherein said diagonal brace is fixedly attached with respect to said extensions by being welded thereto.

5. The structural joint of claim 2 wherein is included a top cover plate and a bottom cover plate, wherein said brace is fixedly attached with respect to said extensions by said brace being bolted to said cover plates, and wherein said cover plates are welded to said extensions.

6. The structural joint of claim 2 wherein is included top and bottom cover plates, wherein said diagonal brace is fixedly attached with respect to said extensions by welds between said brace and said cover plates and welds between said cover plates and said extensions.

7. The structural joint of claim 6 wherein said welds between said cover plates and said extensions extend along lines substantially parallel to the longitudinal direction of said diagonal brace.

8. The structural joint of claim 1, wherein said brace has at least two opposing flanges, and wherein said moment-resisting connection fixedly attaching said gusset plates with respect to said diagonal brace is comprised of a plurality of fasteners disposed in a plurality of rows between said flanges and said gusset plates.

9. The structural joint of claim 1, wherein said diagonal brace is comprised of two flanges and at least one web connected between said flanges, wherein one of said gusset plates is fixedly attached with respect to said diagonal brace by being directly attached to one of said flanges of said diagonal brace, and wherein the other of said gusset plates is fixedly attached with respect to said diagonal brace by being directly attached to the other of said flanges of said diagonal brace, and wherein said normal gravity loading includes a portion of the gravity loading on the floors of the building.

10. The structural joint of claim 1, wherein said diagonal brace has four edges along its longitudinal length, and wherein said gusset plates are fixedly attached with respect to said diagonal brace by welds between said gusset plates and said edges of said brace, said welds extending along said edges of said diagonal brace, along the longitudinal direction of said brace.

11. The structural joint of claim 1, wherein said diagonal brace is comprised of two flanges and a web connected between a top flange and a bottom flange, wherein is included a top cover plate fixedly attached with respect to said top flange, wherein is included a bottom cover plate fixedly attached with respect to said bottom flange, wherein said gusset plates are fixedly attached with respect to said diagonal brace by said cover plates being welded to said gusset plates.

12. The structural joint of claim 11, wherein said cover plates are fixedly attached with respect to said diagonal brace by being one of bolted to said diagonal brace and welded to said diagonal brace.

13. The structural joint of claim 1, wherein said diagonal brace is comprised of two flanges and at least one web connected between said flanges, and wherein said gusset plates are fixedly attached with respect to said diagonal brace with said diagonal brace being oriented with one flange above the other, and wherein said severe moment-resisting connection between said gusset plates and said brace is comprised of welds disposed between said gusset plates and said brace, wherein said welds extend a distance sufficient to make said severe moment-resisting connection strong enough to develop the full capacity of said brace in strength and ductility.

14. The structural joint of claim 13, wherein is included a cover plate on top of the upper flange of said brace and a cover plate on the lower flange of said brace, and wherein said welds, comprising said severe moment-resisting connection between said gusset plates and said brace, are between said gusset plates and said cover plates and between said cover plates and said flanges of said brace.

15. The structural joint of claim 1, wherein said brace has two flanges and a web interconnecting said flanges, wherein said gusset plates are fixedly attached with respect to said diagonal brace, at least in part, by at least one pair of shear plates, each shear plate being located opposite the other on the opposite sides of said web of said brace, and wherein said shear plates are fillet welded to said brace and said gusset plates.

16. The structural joint of claim 1, wherein said structure has floors, and wherein said columnar support provides support for a portion of the gravity loads acting on said floors of said structure.

17. The structural joint of claim 1, wherein said column extends from at, or near, the bottom of said structure.

18. A structural joint comprising a column having four or more flange edges extending in the longitudinal direction of said column, each said flange edge being disposed on said column opposite at least one other flange edge, wherein said column is disposed as a permanent, columnar support in a structure and carrying a load of the magnitude of building columnar loads and similarly heavy structural loads, a beam, wherein one end of said beam is disposed near said column for fixed attachment with respect to said column, a brace which is diagonally disposed with respect to said beam, said brace having two ends, wherein one end of said brace is disposed near said column and said beam, where said beam is disposed near said column, a pair of gusset plates, each gusset plate being disposed in parallel, face-to-face relationship with respect to the other gusset plate, on said opposing flange edges of said column, said gusset plates extending along opposing sides of said beam and said brace, wherein said pair of gusset plates is fixedly attached with respect to said column, at least in part, by each said gusset plate being welded along at least one of said flange edges of said column, wherein each of said gusset plates extends substantially beyond said flange to which it is welded, in the general direction of another flange of said column, wherein said one pair of gusset plates is fixedly attached with respect to said beam, and wherein said one end of said brace is fixedly attached with respect to said pair of gusset plates by moment-resisting connections strong enough to resist severe moment loads caused by normal gravity loading and those severe moment loads having an order of magnitude as large as those caused by disastrous events, such as earthquakes, tornadoes, hurricanes, high winds, blasts and explosions.

19. The structural joint of claim 18, wherein one or more of said column, beam and flange is comprised of two flanges with a web therebetween, and wherein is included two opposing shear plates each disposed between the flanges of, one or more of said column, said beam and said brace, and each said opposing shear plate disposed oppositely from the other shear plate, on opposite sides of the flange of one or more of said column, said beam and said brace.

20. The structural joint of claim 18, wherein said brace has two opposing flanges, and wherein said moment-resisting connections, fixedly attaching said brace to said gusset plates, are comprised of a plurality of fasteners fastening each said flange of said brace to a respective gusset plate, and wherein each said flange of said brace is fastened to its respective gusset plate by a plurality of rows of fasteners, each row having a plurality of fasteners.

21. The structural joint of claim 18, wherein is included a second column, having four or more edges extending in the longitudinal direction of said column, each said edge being disposed on said column opposite at least one other edge, said second column being disposed a horizontal distance from said first column, wherein is included a second beam disposed a distance above said first beam, wherein said second beam has two ends, one end being disposed near said second column for being fixedly attached with respect to said second column and the other end disposed near said first column for being fixedly attached with respect to said first column, wherein is included a second pair of parallel gusset plates, each in parallel, face-to-face relationship, with respect to the other gusset plate of said second pair of gusset plates, on opposing edges of said second column, and on opposing sides of said second beam and the other end of said brace, wherein said second pair of parallel gusset plates are fixedly attached with respect to said second column, at least in part, by each gusset plate being welded along at least one of said edges of said second column, wherein said second pair of parallel gusset plates extend along the sides of said second beam and along the sides of the other end of said brace, and wherein said other end of said brace is fixedly attached with respect to said second pair of parallel gusset plates.

22. The structural joint of claim 21 wherein said brace is comprised of at least first and second flanges, and wherein said brace is fixedly attached with respect to said one pair of gusset plates, at one end of said brace, and said second pair of gusset plates, at the other end of said brace, by each said flange being fastened to a gusset plate of said one pair of gusset plates and a gusset plate of said second pair of gusset plates.

23. The structural joint of claim 21 wherein said brace is comprised of at least first and second flanges, and wherein said brace is fixedly attached with respect to said one pair of gusset plates and said second pair of gusset plates by each said flange being welded, at one end of said brace, to at least one gusset elate of said one pair of gusset plates and, at the other end of said brace, to at least one gusset plate of said second pair of gusset plates.

24. The structural joint of claim 21, wherein is included a first set of top and bottom cover plates, wherein is included a second set of top and bottom cover plates, wherein said brace is comprised of at least a top flange and a bottom flanges wherein said brace is fixedly attached with respect to said one pair of gusset plates by said first top cover plate being attached to said top flange of said brace, at or near one end thereof and welded to said one pair of gusset plates, and said first bottom cover plate being attached to said bottom flange of said cover plate at or near said one end thereof and welded to said one pair of gusset plates, and wherein said brace is fixedly attached with respect to said second pair of gusset plates by said second top cover plate being attached to said top flange of said brace at or near the other end thereof and welded to said second pair of gusset plates, and said second bottom cover plate being attached to said bottom flange of said brace, at or near said other end thereof and welded to said second pair of gusset plates.

25. The structural joint of claim 24, wherein said brace is fixedly attached with respect to said cover plates by one of bolts, rivets and welds.

26. The structural joint of claim 18, wherein said severe moment-resisting connection fixedly attaching said brace with respect to said pair of gusset plates, is comprised of one of (1) a plurality of rows of bolts, each row having a plurality of bolts, (2) a plurality of rows of rivets, each row having a plurality of rivets, and (3) welds of sufficient length to withstand severe moments having the order of magnitude of those moments caused by disastrous events, such as earthquakes, tornadoes, hurricanes, high winds, blasts, explosions and the like.

27. The structural joint of claim 18, wherein is included a second column disposed a preselected, horizontal distance from said first column, wherein is included a second beam disposed a preselected distance above said first beam, wherein said second beam has two ends, one end being disposed near said second column and fixedly attached with respect to said second column and the other end disposed near said first column and fixedly attached with respect to said first column, wherein is included a second pair of parallel gusset plates, wherein said second pair of parallel gusset plates are disposed in face-to-face relationship on opposite sides of said second beam, at an intermediate distance between said columns, wherein said second pair of parallel gusset plates are fixedly attached with respect to said second beam, wherein said second pair of parallel gusset plates extend from said second beam along the sides of said brace at its other end, wherein said brace is fixedly attached with respect to said second pair of parallel gusset plates.

28. The structural joint of claim 18, wherein is included a second column, having at least four edges extending in the longitudinal direction of said column, each said edge being disposed on said column opposite at least one other edge, said second column being disposed a horizontal distance from said first column, wherein the other end of said first beam is disposed near said second column for being fixedly attached with respect to said second column, wherein is included a second beam disposed a distance above said first beam, wherein said second beam has two ends, one end being disposed near said second column and being fixedly attached with respect to said second column and the other end being disposed near said first column and being fixedly attached with respect to said first column, wherein is included a second brace having two ends, wherein is included a second pair of parallel gusset plates, wherein said second pair of parallel gusset plates are disposed in face-to-face relationship on opposing edges of said second column, wherein said second pair of parallel gusset plates are fixedly attached with respect to said second column by each gusset plate of said second pair of parallel gusset plates being welded to at least two of said edges of said second column, wherein said second pair of parallel gusset plates extend along the sides of said other end of said first beam and along the sides of said one end of said second brace, wherein said other end of said first beam is fixedly attached with respect to said second column by being fixedly attached with respect to said second pair of parallel gusset plates, wherein said one end of said second brace is fixedly attached with respect to said second pair of parallel gusset plates, wherein is included additional parallel gusset plate means fixedly attached with respect to said second beam, intermediate the length of said second beam, and fixedly attached with respect to the other ends of said first and second braces, thus, fixedly attaching the other ends of said braces with respect to said second beam intermediate the length of said second beam, between said columns.

29. The structural joint of claim 28, wherein said additional parallel gusset plate means comprise a third pair of parallel gusset plates, disposed on opposite sides of said second beam, intermediate its length and in face-to-face relationship with respect to each other, wherein said gusset plates are fixedly attached with respect to the other ends of said first and second braces by both said first and second braces being attached directly to said third pair of parallel gusset plates.

30. The structural joint of claim 29, wherein said third pair of parallel gusset plates is located at or near the center of said second beam.

31. The structural joint of claim 29, wherein said third pair of parallel plates are located other than at or near the center of said second beam.

32. The structural joint of claim 28 wherein said additional gusset plate means comprise a third pair of parallel gusset plates, each gusset plate disposed on opposite sides of said second beam from the other, in face-to-face relationship with respect to each other and a fourth pair of parallel gusset plates, each gusset plate disposed on opposite sides of said second beam from the other, in face-to-face relationship with respect to each other, wherein the other end of said first brace is fixedly attached with respect to said third pair of parallel gusset plates, and wherein the other end of said second brace is fixedly attached with respect to said fourth pair of parallel gusset plates.

33. The structural joint of claim 18, wherein said severe moment-resisting connections, between said brace and said gusset plates, are strong enough to reach the full yield strength capability of said brace, without the cross-section of said brace having been reduced in area.

34. The structural joint of claim 18, wherein is included shear plates welded between one or more of (1) said gusset plates and said beam and (2) said gusset plates and said brace.

35. A structural joint connection comprising, a brace, a beam having flanges, a column disposed as permanent, columnar support in a structure such as a building, tower and similarly heavy structure, said column having two or more flanges, wherein said brace has two ends, a pair of gusset plates in parallel, face-to-face relationship with each other, said gusset plates disposed on opposite sides of said beam, and on opposite sides of at least one of said flanges of said column, wherein said beam is fixedly attached with respect to said parallel gusset plates in a moment-resisting connection, and wherein said parallel gusset plates are each welded to at least one of said flanges of said column in a moment-resisting connection, wherein each of said gusset plates extends substantially beyond said flange to which it is welded, in the general direction of another flange of said column, wherein said parallel gusset plates extend along the sides of one end of said brace, wherein said one end of said brace is fixedly attached with respect to each of said parallel gusset plates by moment-resisting connection means, and wherein said moment-resisting connection means is sufficiently strong to absorb and dissipate energy caused by severe moment loading of said moment-resisting connection means, beyond normal gravity loading, such as severe moment loading caused by one or more of earthquakes, tornadoes, hurricanes, high winds, blasts, explosions and other disastrous events.

36. The structural joint of claim 35, wherein said brace has at least two flanges, and wherein said moment-resisting connection means for absorbing and dissipating said energy caused by said severe moment loads beyond those caused by normal gravity loading, is comprised of one of (1) a plurality of fasteners between each said brace flange and a respective gusset plate, wherein said plurality of fasteners are disposed in each row of a plurality of rows and (2) welds fixedly attaching said flanges of said brace and a respective gusset plate, said welds being sufficiently long to absorb and dissipate said energy caused by said severe moment loads on said moment-resisting connection means.

37. The structural joint of claim 35, wherein said brace has two flanges, wherein is included a top cover plate and a bottom cover plate, wherein said top cover plate is fixedly attached to one flange of said brace and the bottom cover plate is fixedly attached to the other flange of said brace, wherein said cover plates are fixedly attached by welds to said parallel gusset plates, wherein said welds, fixedly attaching said cover plates to said parallel plates, extend in the longitudinal direction of said brace.

38. A structural joint comprising a column disposed as permanent, columnar support of a structure such as, a building, tower and similarly heavy structure, said column having at least two flanges, a beam having two ends, one end disposed near said column and the other end disposed away from said column, a diagonal brace having two ends, one end disposed near said column and the other end disposed away from said column, wherein said structural joint is comprised of two gusset plates disposed in parallel relationship on opposite sides of at least one of said flanges of said column, wherein said gusset plates are in face-to-face relationship with respect to each other, wherein one of said gusset plates extends along one side of said beam and along one side of said diagonal brace;

wherein the other of said gusset plates extends along the other side of said beam and along the other side of said diagonal brace, wherein each of said gusset plates is connected to said column by being welded to at least one of said flanges of said column, wherein each of said gusset plates extends substantially beyond said flange to which it is welded, in the general direction of another flange of said column, wherein said welded connections, between said gusset plates and said at least one flange of said column, extend along said flange a distance sufficient to resist severe moment loads on said welded connections, such as those severe moment loads caused by normal gravity loading and caused by those having an order of magnitude as large as severe moment loads caused by one or more of earthquakes, tornadoes, hurricanes, high winds, blasts, explosions and the like, wherein each of said gusset plates is fixedly attached with respect to said beam by a connection sufficiently strong to resist severe moment loads beyond normal gravity loading on said latter connection, said loads having an order of magnitude as large as those caused by one or more of earthquakes, tornadoes, hurricanes, high winds, blasts, explosions and the like, wherein said brace is fixedly attached with respect to said gusset plates by connections sufficiently strong to resist severe moment loads and severe axial loads caused by normal gravity loading and caused by those loads having an order of magnitude as large as those caused by one or more of earthquakes, tornadoes, hurricanes, high winds, blasts, explosions and the like.

* * * * *